US008789298B2

(12) United States Patent
Eder et al.

(10) Patent No.: US 8,789,298 B2
(45) **Date of Patent: *Jul. 29, 2014**

(54) ARTICLE OF FOOTWEAR WITH BALL CONTROL PORTION

(71) Applicant: Nike, Inc., Beaverton, OR (US)

(72) Inventors: Colin K. Eder, Portland, OR (US); Windra Fahmi, Beaverton, OR (US); Sebastien Mermet, Creteil (FR); Morgan Stauffer, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/685,798

(22) Filed: Nov. 27, 2012

(65) Prior Publication Data

US 2013/0145655 A1 Jun. 13, 2013

Related U.S. Application Data

(63) Continuation of application No. 12/765,017, filed on Apr. 22, 2010, now Pat. No. 8,356,429.

(51) Int. Cl.
*A43B 5/02* (2006.01)
*A43B 7/08* (2006.01)

(52) U.S. Cl.
USPC ..... 36/133; 36/3 B; 36/45

(58) Field of Classification Search
USPC ..... 36/3 B, 45, 128, 133
See application file for complete search history.

(56) References Cited

U.S. PATENT DOCUMENTS

| | | | |
|---|---|---|---|
| 1,559,114 | A | 10/1925 | Maranville |
| 3,191,321 | A | 6/1965 | Brutting |
| 3,525,165 | A | 8/1970 | Randall, Jr. |
| 3,650,051 | A | 3/1972 | Sass |
| 4,399,621 | A | 8/1983 | Dassler |
| 4,442,615 | A | 4/1984 | Danks |
| 4,452,289 | A | 6/1984 | Smith |
| 4,766,682 | A | 8/1988 | Malloy, III |
| 4,899,470 | A | 2/1990 | Holland, III |
| 5,437,112 | A | 8/1995 | Johnston |
| 5,572,739 | A | 11/1996 | Kolanda et al. |
| 6,038,792 | A | 3/2000 | Hauter |
| 6,421,936 | B1 | 7/2002 | Gerrand |
| 6,523,282 | B1 | 2/2003 | Johnston |
| 6,681,503 | B2 | 1/2004 | Morle |
| 6,904,615 | B2 | 6/2005 | Kobe et al. |
| 7,487,605 | B2 | 2/2009 | Hatzilias |
| 8,196,322 | B2 | 6/2012 | Atsumi et al. |
| 8,356,429 | B2 | 1/2013 | Eder et al. |
| 2003/0167658 | A1 | 9/2003 | Davis |
| 2004/0055183 | A1 | 3/2004 | Lee et al. |
| 2004/0088888 | A1 | 5/2004 | Johnston |
| 2006/0218821 | A1 | 10/2006 | Hatzilias |
| 2010/0077637 | A1 | 4/2010 | Hatzilias |
| 2011/0247240 | A1 | 10/2011 | Eder et al. |
| 2011/0258883 | A1 | 10/2011 | Eder et al. |

FOREIGN PATENT DOCUMENTS

| | | |
|---|---|---|
| DE | 2743666 | 3/1978 |
| DE | 2827172 | 1/1980 |

(Continued)

*Primary Examiner* — Marie Bays

(74) *Attorney, Agent, or Firm* — Plumsea Law Group, LLC

(57) ABSTRACT

A ball control portion for an article of footwear is disclosed. The ball control portion extends from a side to an underside of an article of footwear. The ball control portion includes a lattice with a plurality of protrusions arranged in a grid. The plurality of protrusions include multiple groups of protrusions arranged with one or more of different orientations, different types of protrusions, and different heights.

32 Claims, 17 Drawing Sheets

(56) References Cited

FOREIGN PATENT DOCUMENTS

| | | |
|---|---|---|
| EP | 0496931 | 8/1992 |
| GB | 409010 | 4/1934 |
| GB | 2259639 | 3/1993 |
| JP | 83312101 | 12/1996 |
| JP | 9028412 | 2/1997 |
| JP | 2002248006 | 9/2002 |
| RU | 2015675 | 7/1994 |
| WO | WO9632856 | 10/1996 |
| WO | WO2007144331 | 12/2007 |

ARTICLE OF FOOTWEAR WITH BALL CONTROL PORTION

This application is a continuation of U.S. Pat. No. 8,356,429, currently U.S. application Ser. No. 12/765,017, entitled "Article of Footwear with Ball Control Portion", filed on Apr. 22, 2010 and issued on Jan. 22, 2013, which application is hereby incorporated by reference in its entirety.

BACKGROUND

The present invention relates generally to an article of footwear, and in particular to an article of footwear with a ball control portion.

Maranville (U.S. Pat. No. 1,559,114) teaches a series of nubs that are arranged in a generally oval configuration in several areas on a rubber glove to increase grip. Kolada (U.S. Pat. No. 5,572,739) teaches a baseball glove that includes protrusions made of an elastomeric material that improve a user's grip on a ball that is caught.

Smith (U.S. Pat. No. 4,452,289) teaches a hand tool with tread means. The tread means are arranged in rows. Smith teaches that the handle has advantageous hand "feel" since the outer body has sufficient pliability to conform to the shape and size of the palm.

Brutting (U.S. Pat. No. 3,191,321) teaches a soccer shoe with a ball control surface. Danks (U.S. Pat. No. 4,442,615) teaches sports footwear that includes a friction pad for a surface of an article of footwear that can reduce spin of a ball and reduce energy of an impact with a ball. Johnston (U.S. Pat. No. 6,523,282) teaches an article of footwear for gripping and kicking a ball. Hatzilias (U.S. Pat. No. 7,487,605) teaches footwear for gripping and kicking a ball.

SUMMARY

In one aspect, the invention provides an article of footwear, comprising: a ball control portion associated with a medial side of the article of footwear; the ball control portion comprising a lattice including a plurality of protrusions that are configured to bend; each protrusion of the plurality of protrusions including a major axis, a minor axis and a normal axis, the normal axis being approximately perpendicular to the major axis and the minor axis; each protrusion of the plurality of protrusions further including a major face that extends in a direction along the major axis and in a direction along the normal axis; wherein the plurality of protrusions are integrally formed with the lattice; and wherein the lattice comprises a plurality of connecting members connecting the plurality of protrusions.

In one aspect, the invention provides an article of footwear, comprising: a ball control portion associated with a medial side and an underside of the article of footwear; the ball control portion comprising a plurality of protrusions that are configured to bend; each protrusion of the plurality of protrusions including a major axis, a minor axis and a normal axis, the normal axis being approximately perpendicular to the major axis and the minor axis; each protrusion of the plurality of protrusions further including a major face that extends in a direction along the major axis and in a direction along the normal axis; wherein a first group of protrusions of the plurality of protrusions associated with the medial side are approximately oriented in a first direction along the major axis; and wherein a second group of protrusions of the plurality of protrusions associated with the underside are approximately oriented in a second direction along the major axis that is different from the first direction.

In one aspect, an article of footwear, comprising: an upper; a sole structure; a ball control portion associated with the upper and the sole structure; the ball control portion comprising a plurality of protrusions that are configured to bend; each protrusion of the plurality of protrusions including a major axis, a minor axis and a normal axis, the normal axis being approximately perpendicular to the major axis and the minor axis; each protrusion of the plurality of protrusions further including a major face that extends in a direction along the major axis and in a direction along the normal axis; and wherein the ball control portion further comprises a first portion extending in a vertical direction along a medial side of the article of footwear adjacent to the upper and a second portion extending in a lateral direction along an underside of the article of footwear adjacent to the sole structure.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
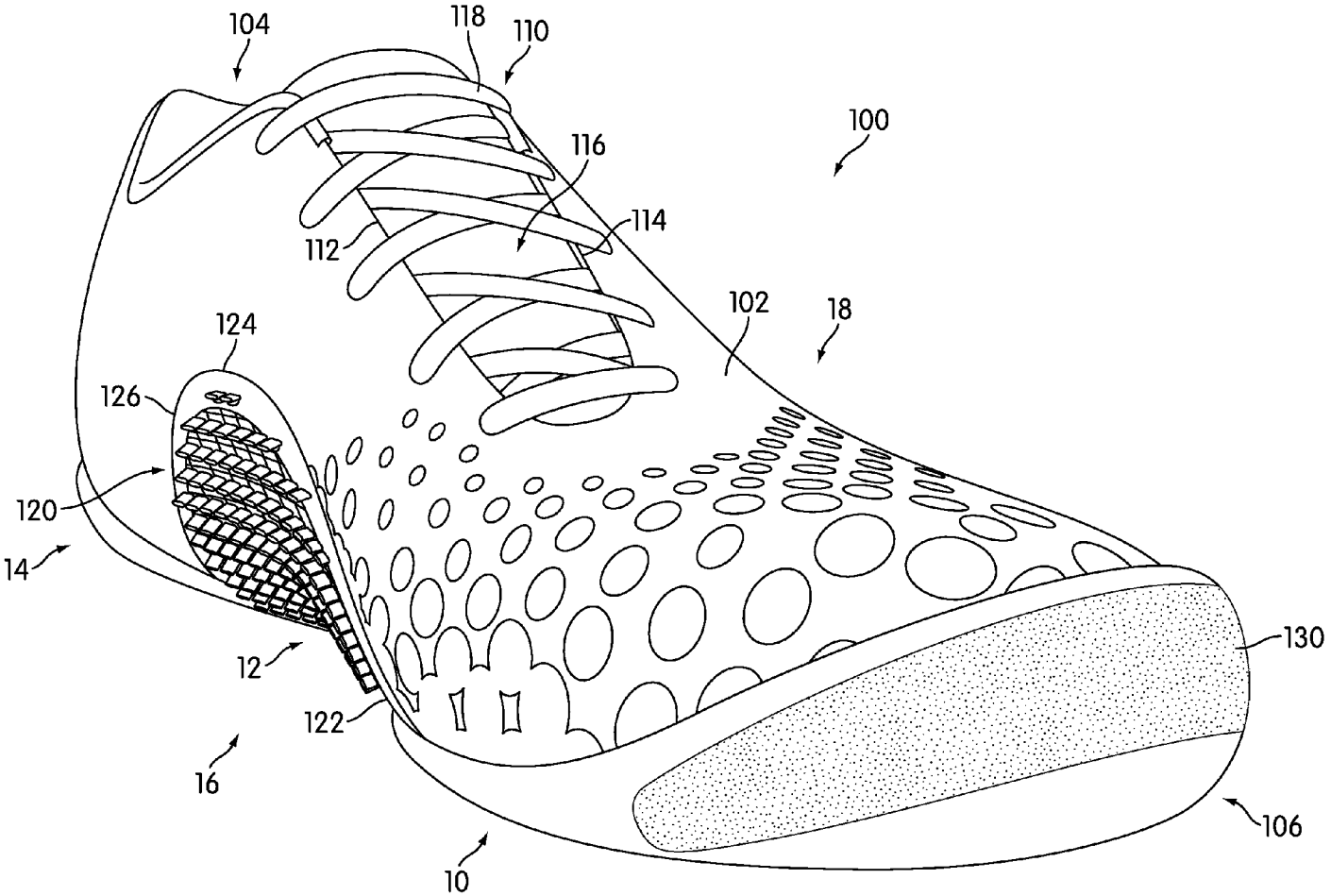
FIG. 1 is an isometric view of an embodiment of an article of footwear including a ball control portion.

FIGS. 1 through 5 illustrate an exemplary embodiment of article of footwear 100. For clarity, the following detailed description discusses an exemplary embodiment, in the form of a sports shoe, but it should be noted that the present invention could take the form of any article of footwear including, but not limited to: hiking boots, soccer shoes, football shoes, sneakers, rugby shoes, basketball shoes, baseball shoes as well as other kinds of shoes. As shown in FIGS. 1 through 5, article of footwear 100, also referred to simply as article 100, is intended to be used with a left foot; however, it should be understood that the following discussion may equally apply to a mirror image of article of footwear 100 that is intended for use with a right foot.

Referring to FIGS. 1 through 5, for purposes of reference, article 100 may include forefoot region 10, midfoot region 12 and heel region 14. Forefoot region 10 may be generally associated with the toes and joints connecting the metatarsals with the phalanges. Midfoot region 12 may be generally associated with the arch of a foot. Likewise, heel region 14 may be generally associated with the heel of a foot, including the calcaneus bone. In addition, article 100 may include medial side 16 and lateral side 18. In particular, medial side 16 and lateral side 18 may be opposing sides of article 100. Furthermore, both medial side 16 and lateral side 18 may extend through forefoot region 10, midfoot region 12 and heel region 14.

It will be understood that forefoot region 10, midfoot region 12 and heel region 14 are only intended for purposes of description and are not intended to demarcate precise regions of article 100, but rather, to describe relative positions. Likewise, medial side 16 and lateral side 18 are intended to represent generally two sides of an article, rather than precisely demarcating article 100 into two halves. In addition, forefoot region 10, midfoot region 12 and heel region 14, as well as medial side 16 and lateral side 18, can also be applied to individual components of an article, such as a sole structure and/or an upper.

For consistency and convenience, directional adjectives are employed throughout this detailed description corresponding to the illustrated embodiments. The term "longitudinal" as used throughout this detailed description and in the claims refers to a direction extending a length of an article. In some cases, the longitudinal direction may extend from a forefoot region to a heel region of the article. Also, the term "lateral" as used throughout this detailed description and in the claims refers to a direction extending a width of an article. In other words, the lateral direction may extend between a medial side and a lateral side of an article. Furthermore, the term "vertical" as used throughout this detailed description and in the claims refers to a direction generally perpendicular to a lateral and longitudinal direction. For example, in cases where an article is planted flat on a ground surface, the vertical direction may extend from the ground surface upward. It will be understood that each of these directional adjectives may be applied to individual components of an article, such as an upper and/or a sole structure.

Article 100 may include an upper 102 and sole structure 106. In some embodiments, sole structure 106 may be configured to provide traction for article 100. In addition to providing traction, sole structure 106 may attenuate ground reaction forces when compressed between the foot and the ground during walking, running or other ambulatory activities. The configuration of sole structure 106 may vary significantly in different embodiments to include a variety of conventional or non-conventional structures. In some cases, the configuration of sole structure 106 may be configured according to one or more types of ground surfaces on which sole structure 106 may be used. Examples of ground surfaces include, but are not limited to: natural turf, synthetic turf, dirt, as well as other surfaces.

Sole structure 106 is secured to upper 102 and extends between the foot and the ground when article 100 is worn. In different embodiments, sole structure 106 may include different components. For example, sole structure 106 may include an outsole, a midsole, and/or an insole. In some cases, one or more of these components may be optional. Sole structure 106 may be made from any suitable material, including a material that includes, but is not limited to, elastomers, siloxanes, natural rubber, other synthetic rubbers, aluminum, steel, natural leather, synthetic leather, or plastics.

In some embodiments, portions of sole structure 106 may include provisions for enhancing traction for purposes of better ball control during kicks. In one embodiment, sole structure 106 may include portions disposed along an outer periphery comprising a material that has a high coefficient of friction to provide better grip on a ball during kicks. In an exemplary embodiment, sole structure 106 may include a toe grip 130 disposed along an outer periphery of sole structure 106 at forefoot region 10. In various embodiments, toe grip 130 may comprise a roughened surface material for enhancing traction with a ball, including, but not limited to materials that include natural rubber, synthetic rubber, natural leather, synthetic leather, or plastics, as well as any other suitable material.

Article of footwear 100 may include upper 102. Generally, upper 102 may be any type of upper. In particular, upper 102 may have any design, shape, size and/or color. For example, in embodiments where article 100 is a soccer shoe, upper 102 could be a low top upper. In embodiments where article 100 is a basketball shoe, upper 102 could be a high top upper that is shaped to provide high support on an ankle. Generally, upper 102 may be made from any suitable material, including a material that includes, but is not limited to, nylon, natural leather, synthetic leather, natural rubber, or synthetic rubber. In some cases, upper 102 can be made of any suitable knitted, woven or non-woven material.

For purposes of clarity, only some portions of upper 102 are discussed in the exemplary embodiments. It should be understood that upper 102 may include other provisions that are known in the art for assisting in walking, running or other athletic maneuvers.

Typically, upper 102 may be configured to receive a foot of a wearer. In some embodiments, upper 102 includes entry hole or throat opening 104 configured to receive a foot of a wearer. With this arrangement, entry hole or throat opening 104 may allow a foot to be inserted into an interior of upper 102.

Article 100 may include lacing system 110. In some cases, lacing system 110 may include a medial lacing edge 112 and a lateral lacing edge 114 that are separated by lacing gap 116. In particular, lacing gap 116 may extend from throat opening 104 of upper 102 towards forefoot region 10. In addition, lacing gap 116 may be associated with one or more lacing holes that are disposed on medial lacing edge 112 and lateral lacing edge 114. Furthermore, lacing gap 116 may be further associated with a lace 118 that may be disposed through one or more lacing holes. With this arrangement, lace 118 may be used to tighten upper 102 around a foot.

In different embodiments, the shape of lacing gap 116 may vary. In some cases, lacing gap 116 may have a substantially straight shape. In other cases, lacing gap 116 may have a curved shape. In one embodiment, lacing gap 116 may be shaped to curve towards medial side 16 from throat opening 104. In other words, lacing gap 116 may be arranged in an asymmetric manner on upper 102.

Article of footwear 100 may include one or more provisions for controlling a ball when contacted by portions of article 100. In one embodiment, article 100 may include a ball control portion 120. Ball control portion 120 may include provisions for enhancing traction of portions of an article for purposes of better ball control during kicks. In some cases, ball control portion 120 may include portions comprising a material that has a high coefficient of friction to provide better grip on a ball during kicks. In other cases, ball control portion 120 may include structural features on portions of an article to help enhance friction. For example, in some cases, ball control portion 120 may include structural features that are intended to increase surface area at a point of contact of the ball which may help enhance traction between the upper and the ball.

In some embodiments, ball control portion 120 may be associated with upper 102. In an exemplary embodiment, ball control portion 120 may be associated with medial side 16 of article 100. In this embodiment, ball control portion 120 may extend through portions of medial side 16 of upper 102. For example, in the current embodiment ball control portion 120 may extend from an area adjacent to medial lacing edge 112 to sole structure 106 in a generally vertical direction. In some cases, ball control portion 120 may extend between forefoot region 10 and heel region 14 in a generally longitudinal direction. In particular, a medial front edge 122 of ball control portion 120 may be disposed adjacent to sole structure 106 at forefoot region 10. In addition, in some cases, ball control portion 120 may rise away from sole structure 106 at midfoot region 12 and extend to a medial midsection edge 124. In some embodiments, medial midsection edge 124 may be disposed near a portion of upper 102 adjacent to lacing system 110. Also, a medial rear edge 126 of ball control portion 120 may be disposed adjacent to sole structure 106 at heel region 14.

Figure 2:
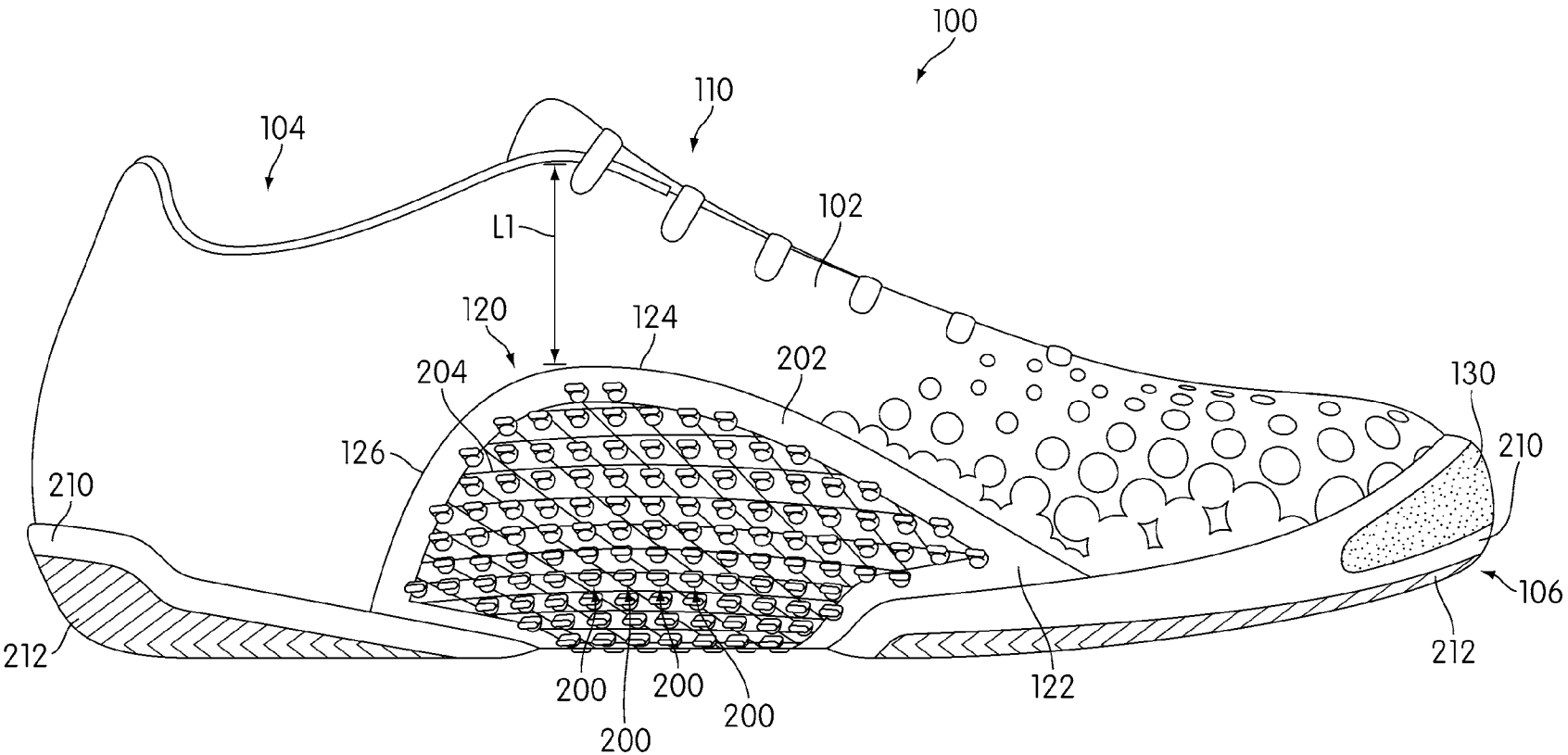
FIG. 2 is a side view of an embodiment of a medial side of an article of footwear including a ball control portion.

Referring now to FIG. 2, in some embodiments, a portion of ball control portion 120 may extend in a vertical direction along medial side 16 of article 100 adjacent to upper 102. In this embodiment, ball control portion 120 extends along medial side 16 of article 100 at midfoot region 12 to medial midsection edge 124. In an exemplary embodiment, medial midsection edge 124 of ball control portion 120 may be disposed a first distance L1 along a vertical direction from the top of article 100. In one embodiment, first distance L1 may be configured to approximately correspond to the location of an arch of a foot of a wearer. In other embodiments, first distance L1 may be configured to approximately correspond to the diameter of a ball. In different embodiments, ball control portion 120 may extend along medial side 16 in a vertical direction more or less than first distance L1.

In some embodiments, ball control portion 120 may taper from first distance L1 at medial midsection edge 124 towards medial front edge 122 in forefoot region 10 adjacent to sole structure 106. Similarly, ball control portion 120 may taper from first distance L1 at medial midsection edge 124 towards medial rear edge 126 in heel region 14 adjacent to sole structure 106. In this embodiment, ball control portion 120 tapers gradually towards medial front edge 122 from first distance L1. In this embodiment, ball control portion 120 may taper rapidly towards medial rear edge 126 from first distance L1. In different embodiments, ball control portion 120 may taper more or less gradually from first distance L1 at medial midsection edge 124 into forefoot region 10 and/or heel region 14.

In some embodiments, ball control portion 120 may include provisions for increasing grip between an article and a ball. In one embodiment, ball control portion 120 may include a plurality of protrusions 200. Generally, plurality of protrusions 200 may be any type of protrusions that extend outwards from the outer surface of article 100. In different embodiments, plurality of protrusions 200 may be configured in various ways. For example, in some cases, plurality of protrusions 200 may be characterized as fin-like protrusions. In other cases, plurality of protrusions 200 may be characterized as flap-like protrusions. In still other cases, protrusions 200 may be any type and/or shape of protrusion. In this embodiment, plurality of protrusions 200 may be characterized as fin-like protrusions.

In different embodiments, plurality of protrusions 200 may be associated with different portions of ball control portion 120. In some cases, plurality of protrusions 200 may be disposed in a grid-like arrangement. In other cases, plurality of protrusions 200 may be disposed in a non-uniform arrangement. In other embodiments, plurality of protrusions 200 may be disposed in various patterns and/or arrangements over one or more portions of ball control portion 120.

In some embodiments, ball control portion 120 may include a lattice 202. Generally, lattice 202 may be a layer of material that is applied to article 100. In some cases, lattice 202 may comprise a contoured layer that generally conforms to the contours of medial side 16 of upper 102. In other cases, lattice 202 may be an initially flat layer that is stretched or otherwise wrapped over the contoured surface of upper 102 and/or other portions of article 100.

In different embodiments, the structure of lattice 202 may vary. In some cases, lattice 202 may comprise a substantially uniform layer. In other cases, lattice 202 may comprise a non-uniform layer. In the current embodiment, lattice 202 may comprise a substantially webbed layer including connecting members 204 that are spaced apart by gaps. In other embodiments, lattice 202 may comprise a substantially solid layer without gaps.

In an exemplary embodiment, plurality of protrusions 200 may be disposed on lattice 202. In some embodiments, plurality of protrusions 200 may be connected by connecting members 204. In one embodiment, plurality of protrusions 200 and connecting members 204 may comprise lattice 202. In some cases, plurality of protrusions 200 and/or connecting members 204 may be integrally formed with lattice 202. In other cases, plurality of protrusions 200, connecting members 204, and/or lattice 202 may be separately formed. In other embodiments, one or more of plurality of protrusions 200, connecting members 204, and/or lattice 202 may be applied to ball control portion 120 of article 100.

In different embodiments, plurality of protrusions 200 may be associated with different portions of lattice 202. In some cases, plurality of protrusions 200 may be disposed on connecting members 204. In other cases, plurality of protrusions 200 may be disposed at the intersection of one or more connecting members 204. In an exemplary embodiment, plurality of protrusions 200 may be disposed in rows and columns connected by connecting members 204 to form a grid-like arrangement of lattice 202.

For purposes of characterizing the size, geometry and/or orientation of a protrusion, each protrusion discussed in this detailed description and in the claims may be associated with a set of axes that are defined relative to each protrusion. The term "major axis" as used throughout this detailed description and in the claims refers to an axis extending through a length of a protrusion. The term "minor axis" as used throughout this detailed description and in the claims refers to an axis extending through a width of a protrusion. Furthermore, the term "normal axis" as used throughout this detailed description and in the claims refers to a direction extending through a height of the protrusion, which is generally perpendicular (or normal) to a plane formed between the major axis and the minor axis. It should be understood that these axes are defined locally with respect to an individual protrusion so that a major axis of one protrusion may not be coincident with a major axis of another protrusion.

In different embodiments, the materials used for ball control portion 120 including plurality of protrusions 200, lattice 202, and/or connecting members 204 may vary. In some embodiments, lattice 202 of ball control portion 120 and plurality of protrusions 200 disposed on lattice 202 may be made of a substantially similar material. For example, in one embodiment, lattice 202 and plurality of protrusions 200, may be made of a substantially monolithic molded material. Examples of materials for making a ball control portion include, but are not limited to, materials that include: elastomers, siloxanes, natural rubber, other synthetic rubbers as well as any other materials. In some cases, materials with relatively high coefficients of friction may be used to increase grip on a ball. In other embodiments, however, plurality of protrusions 200 may be made of a substantially different material than lattice 202. For example, in another embodiment, lattice 202 of ball control portion 120 may be made of a material with a lower coefficient of friction than a material used for plurality of protrusions 200.

In some embodiments, sole structure 106 of article of footwear 100 may include a midsole 210 and an outsole 212. In other embodiments, sole structure 106 may additionally include an insole. In this embodiment, midsole 210 may be attached to a lower area of upper 102. Midsole 210 may be attached to upper 102 using any suitable attachment mechanism, including, but not limited to: stitching, adhesive bonding, and/or heat bonding. Midsole 210 may extend through each of forefoot region 10, midfoot region 12, and/or heel region 104 between medial side 16 and lateral side 18.

In one exemplary embodiment, midsole 210 may be constructed of a polymer foam material, including, but not limited to polyurethane or ethylvinylacetate, that attenuates ground reaction forces as sole structure 106 is compressed between the foot and the ground. In other embodiments, midsole 210 may be constructed from any suitable material, including a material that includes, but is not limited to, elastomers, siloxanes, natural rubber, other synthetic rubbers, and/or plastics. In some embodiments, midsole 210 may include toe grip 130 disposed along an outer periphery of article 100.

As shown in FIG. 2, midsole 210 may extend between upper 102 and outsole 212. In some embodiments, outsole 212 may be attached to midsole 210 using any suitable attachment mechanism. In other embodiments, portions of midsole 210 and/or outsole 212 may be integrally formed from one or more materials. In one exemplary embodiment, sole structure 106 may be constructed using injection molding to form integral midsole 210 and outsole 212. In some embodiments, outsole 212 may be constructed from natural or synthetic rubber. In different embodiments, outsole 212 may be constructed from any suitable durable and wear-resistant material, including a material that includes, but is not limited to, elastomers, siloxanes, natural rubber, other synthetic rubbers, and/or plastics.

Figure 3:
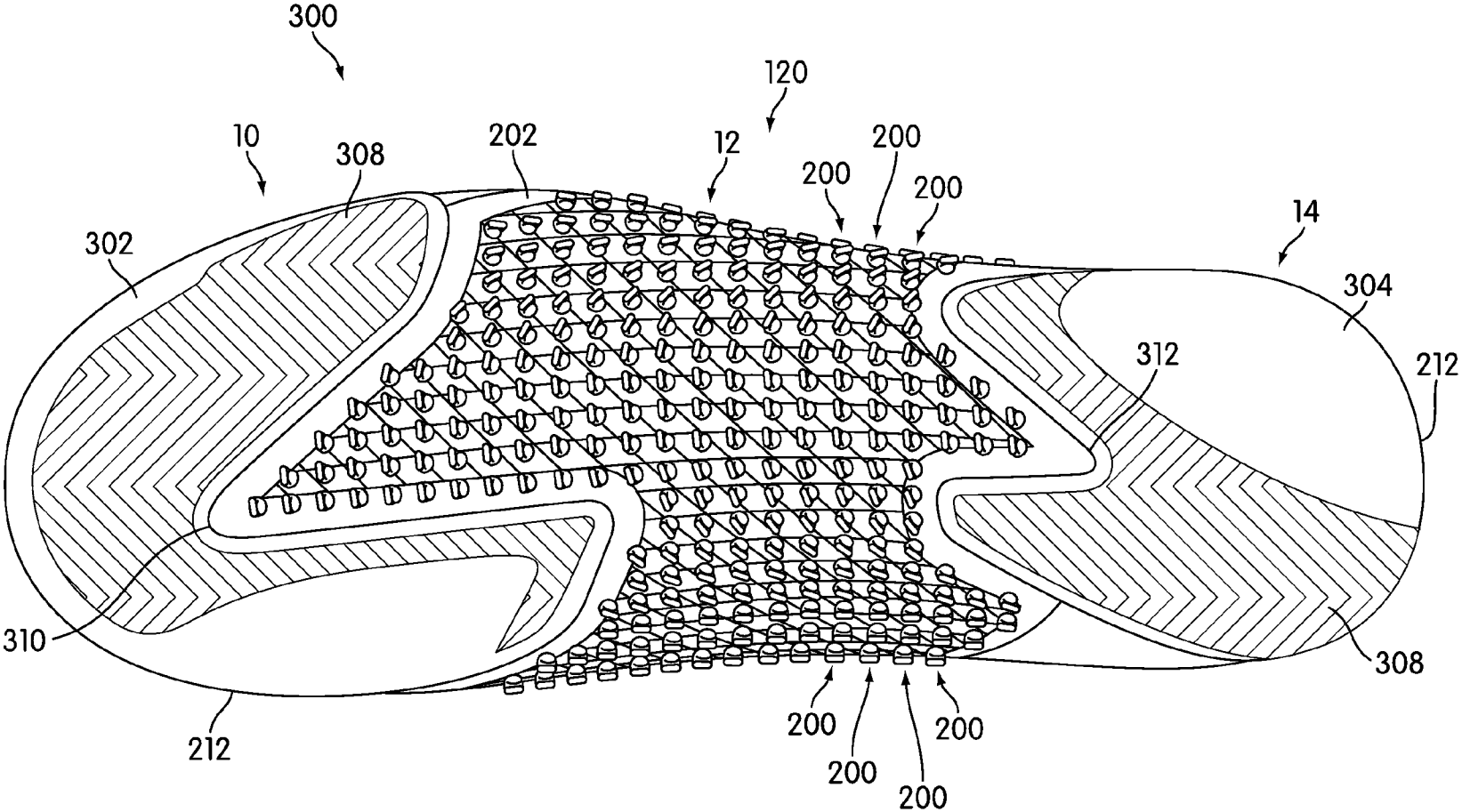
FIG. 3 is a top view of an embodiment of an underside of an article of footwear including a ball control portion.

Referring now to FIG. 3, outsole 212 may be disposed on an underside 300 of article of footwear 100. In this embodiment, outsole 212 may comprise one or more portions disposed in forefoot region 10 and/or heel region 14. In this embodiment, outsole 212 may include a forefoot outsole portion 302. Forefoot outsole portion 302 may be disposed generally in forefoot region 10 of underside 300 of article 100. Additionally, outsole 212 may include a heel outsole portion 304. Heel outsole portion 304 may be disposed generally in heel region 14 of underside 300 of article 100. In other embodiments, forefoot outsole portion 302 and/or heel outsole portion 304 may extend into a portion of midfoot region 12 along underside 300.

In some embodiments, one or more portions of outsole 212, including forefoot outsole portion 302 and/or heel outsole portion 304 may include tread elements 308. Tread elements 308 may provide traction for article 100 with a ground surface. In some embodiments, various tread elements 308 may be provided for different types of surfaces. Tread elements 308 may include any types of tread elements known in the art. In other embodiments, tread elements 308 may be optional.

In some embodiments, ball control portion 120 may extend to underside 300 of article of footwear 100. In one embodiment, ball control portion 120 extends along underside 300 of article 100 in midfoot region 12. In this embodiment, ball control portion 120 extends from medial side 16 to lateral side 18 of midfoot region 12 of underside 300. In other embodiments, ball control portion 120 may extend into a portion of forefoot region 10 and/or heel region 14 of underside 300.

In some embodiments, ball control portion 120 may extend along underside 300 between one or more portions of outsole 212. In one embodiment, ball control portion 120 may extend along midfoot region 12 of underside 300 between forefoot outsole portion 302 and heel outsole portion 304. In an exemplary embodiment, ball control region 120 may extend to a forefoot edge 312 located in forefoot region 10 of underside 300. In one embodiment, forefoot edge 312 of ball control portion 120 may be located adjacent to forefoot outsole portion 302. In an exemplary embodiment, ball control region 120 may extend to a heel edge 314 located in heel region 14 of underside 300. In one embodiment, heel edge 314 of ball control portion 120 may be located adjacent to heel outsole portion 304. In other embodiments, ball control portion 120 may extend more or less distance into forefoot region 10 and/or heel region 14.

In some embodiments, ball control portion 120 disposed on underside 300 of article 100 may provide traction for article 100. In an exemplary embodiment, ball control portion 120 disposed on underside 300 may include lattice 202 and plurality of protrusions 200. With this arrangement, plurality of protrusions 200 may provide traction with a ground surface for article 100. In some cases, plurality of protrusions 200 may be a similar height as outsole 212. In other cases, plurality of protrusions 200 may be longer or shorter than outsole 212.

In some embodiments, ball control portion 120 disposed on underside 300 of article 100 may be configured to control a ball. In an exemplary embodiment, lattice 202 and plurality of protrusions 200 on underside 300 may be arranged for a wearer to trap a ball between article 100 and a ground surface.

Figure 4:
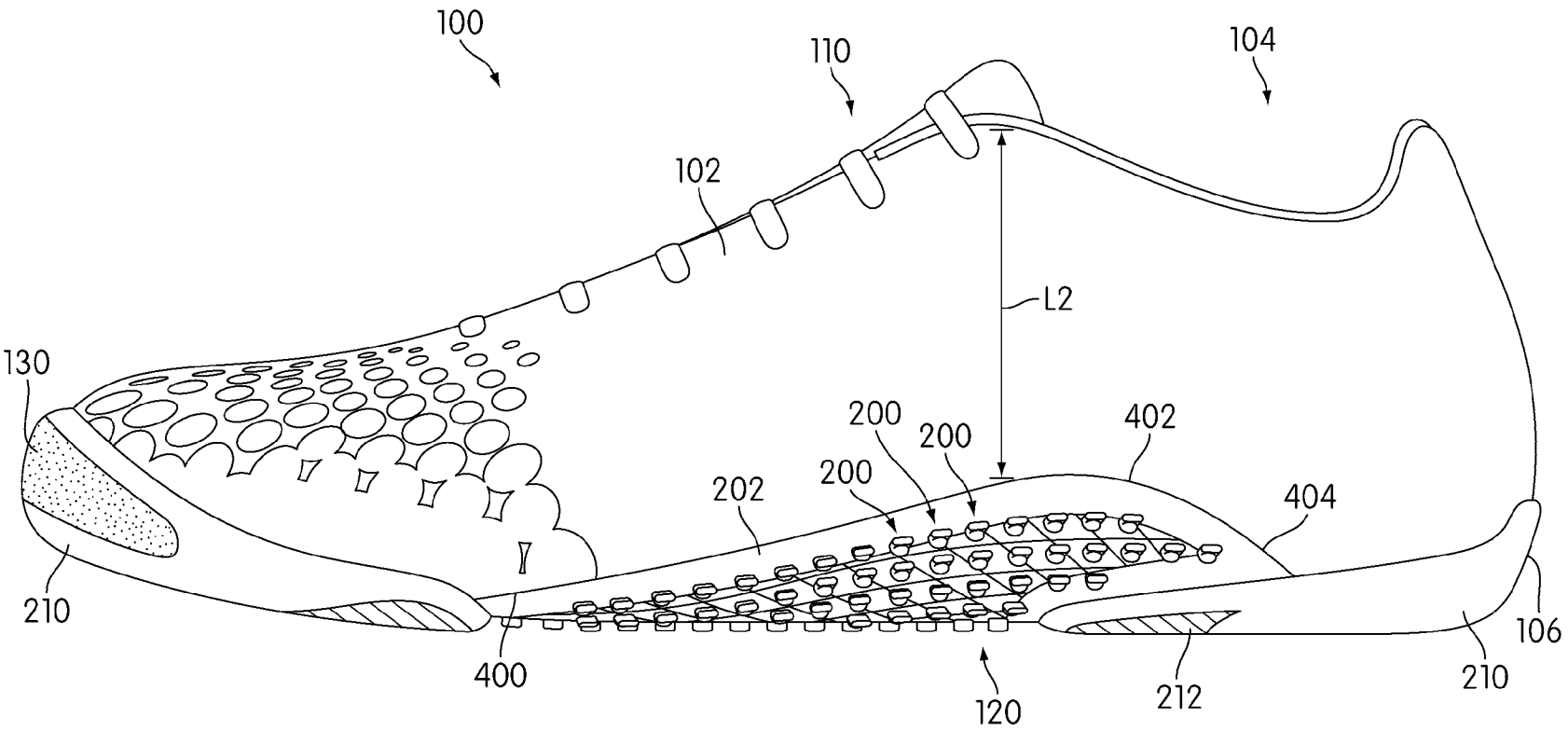
FIG. 4 is a side view of an embodiment of a lateral side of an article of footwear including a ball control portion.

Referring now to FIG. 4, in some embodiments, ball control portion 120 may extend through portions of lateral side 18 of upper 102. For example, in the current embodiment, ball control portion 120 may extend from an area adjacent to lacing system 110 to sole structure 106 in a generally vertical direction. In some cases, ball control portion 120 may extend between forefoot region 10 and heel region 14 on lateral side 18 in a generally longitudinal direction. In particular, a lateral front edge 400 of ball control portion 120 may be disposed adjacent to sole structure 106 at forefoot region 10. In addition, in some cases, ball control portion 120 may rise away from sole structure 106 at midfoot region 12 and extend to a lateral midsection edge 402. In some embodiments, lateral midsection edge 402 may be disposed near a portion of upper 102 below lacing system 110. Also, a lateral rear edge 404 of ball control portion 120 may be disposed adjacent to sole structure 106 at heel region 14.

In some embodiments, a portion of ball control portion 120 may extend in a vertical direction along lateral side 18 of article 100 adjacent to upper 102. In this embodiment, ball control portion 120 extends along lateral side 18 of article 100 at midfoot region 12 to lateral midsection edge 402. In an exemplary embodiment, lateral midsection edge 402 of ball control portion 120 may be disposed a second distance L2 along a vertical direction away from the top of article 100. In one embodiment, second distance L2 may be configured to approximately correspond to the location of a lateral side of a foot of a wearer. In some embodiments, second distance L2 may be substantially greater than first distance L1 on medial side 16. In other words, ball control portion 120 may extend less distance in a vertical direction from sole structure 106 on lateral side 18 than on medial side 16.

In some embodiments, ball control portion 120 may taper from second distance L2 at lateral midsection edge 402 towards lateral front edge 400 in forefoot region 10 adjacent to sole structure 106. Similarly, ball control portion 120 may taper from second distance L2 at lateral midsection edge 402 towards lateral rear edge 404 in heel region 14 adjacent to sole structure 106. In this embodiment, ball control portion 120 tapers gradually towards lateral front edge 400 from second distance L2. In this embodiment, ball control portion 120 may taper rapidly towards lateral rear edge 404 from second distance L2. In different embodiments, ball control portion 120 may taper more or less gradually from second distance L2 at lateral midsection edge 402 into forefoot region 10 and/or heel region 14.

Figure 5:
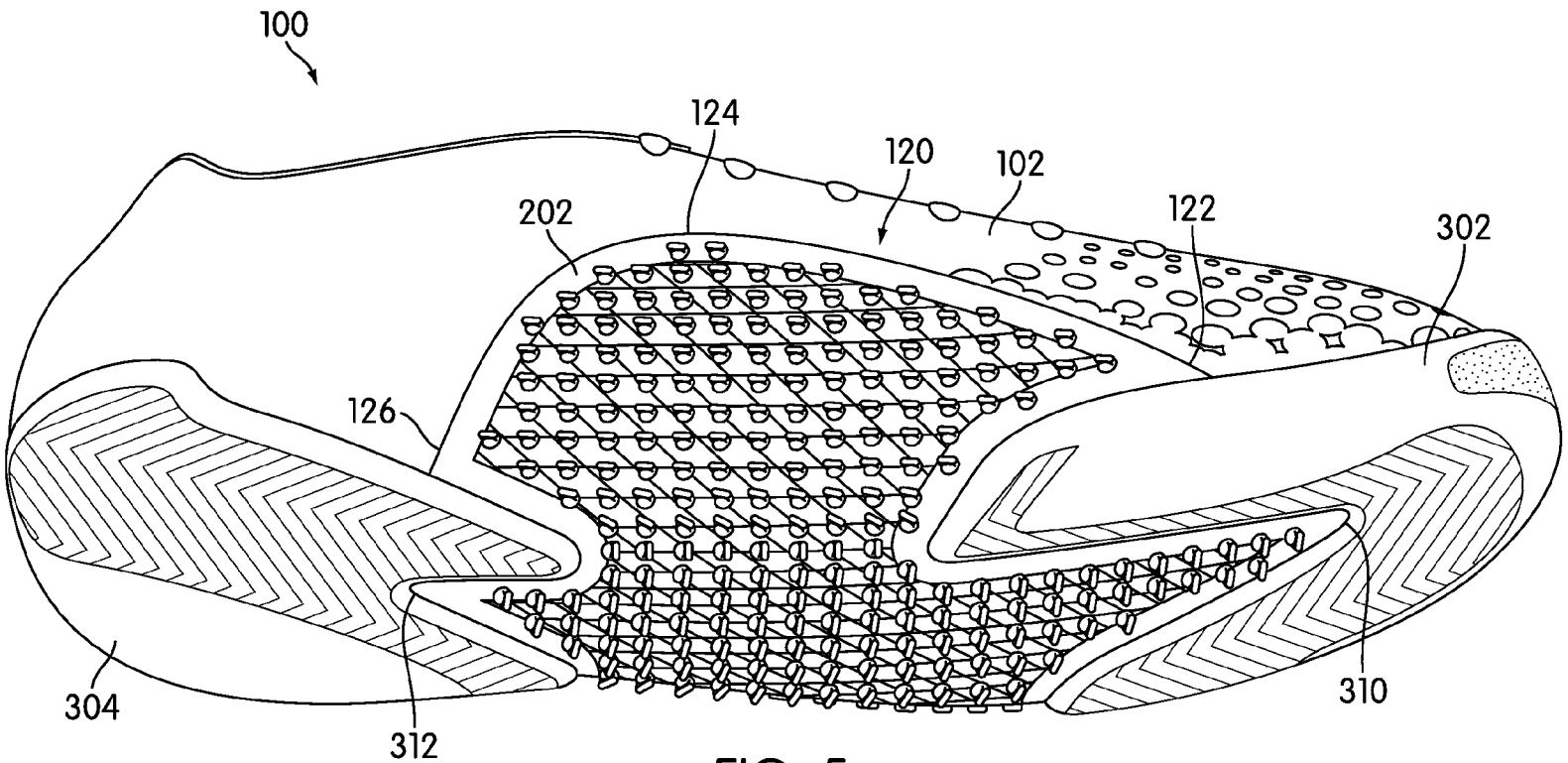
FIG. 5 is an isometric view of an embodiment of an article of footwear including a ball control portion disposed over a medial side and an underside.

In some embodiments, ball control portion 120 may be associated with one or more portions of article 100. In one embodiment ball control portion may be associated with one or more of medial side 16, lateral side 18, and/or underside 300 of article 100. FIG. 5 illustrates an exemplary embodiment of article of footwear 100 with ball control portion 120 associated with medial side 16 and underside 300. In this embodiment, ball control portion 120 may be disposed over a portion of medial side 16 adjacent to upper 102 and a portion of underside 300 disposed between forefoot outsole portion 302 and heel outsole portion 304. In this embodiment, ball control portion 120 may extend forward on article 100 to medial front edge 122 in forefoot region 10 of medial side 16 adjacent to sole structure 106. Similarly, ball control portion 120 may extend forward on article 100 to forefoot edge 310 in forefoot region 10 of underside 300 adjacent to forefoot outsole portion 302. Ball control portion 120 may extend rearward on article 100 to medial rear edge 126 of medial side 16 and to heel edge 312 on underside 300 in heel region 14 of article 100.

In some embodiments, portions of ball control portion 120 associated with each of medial side 16, lateral side 18, and/or underside 300 of article 100 may be substantially continuous between one or more portions. In other words, ball control portion 120 may include a substantially continuous lattice 202 disposed over article 100 extending from medial side 16 to underside 300 of article 100. In other embodiments, ball control portion 120 may include a substantially continuous lattice 202 extending between medial side 16, underside 300, and lateral side 18 of article 100. In some embodiments, ball control portion 120 may be substantially continuous between lateral side 18 and underside 300. In some cases, one or more portions of ball control portion 120 may not be substantially continuous with one or more other portions of ball control portion 120. For example, in one embodiment, lattice 202 may be substantially continuous between medial side 16 and underside 300, however, a separate lattice may form ball control portion 120 on lateral side 18 of article 100. In still other embodiments, ball control portion 120 associated with each of medial side 16, lateral side 18, and/or underside 300 of article 100 may be separate.

Figure 6:
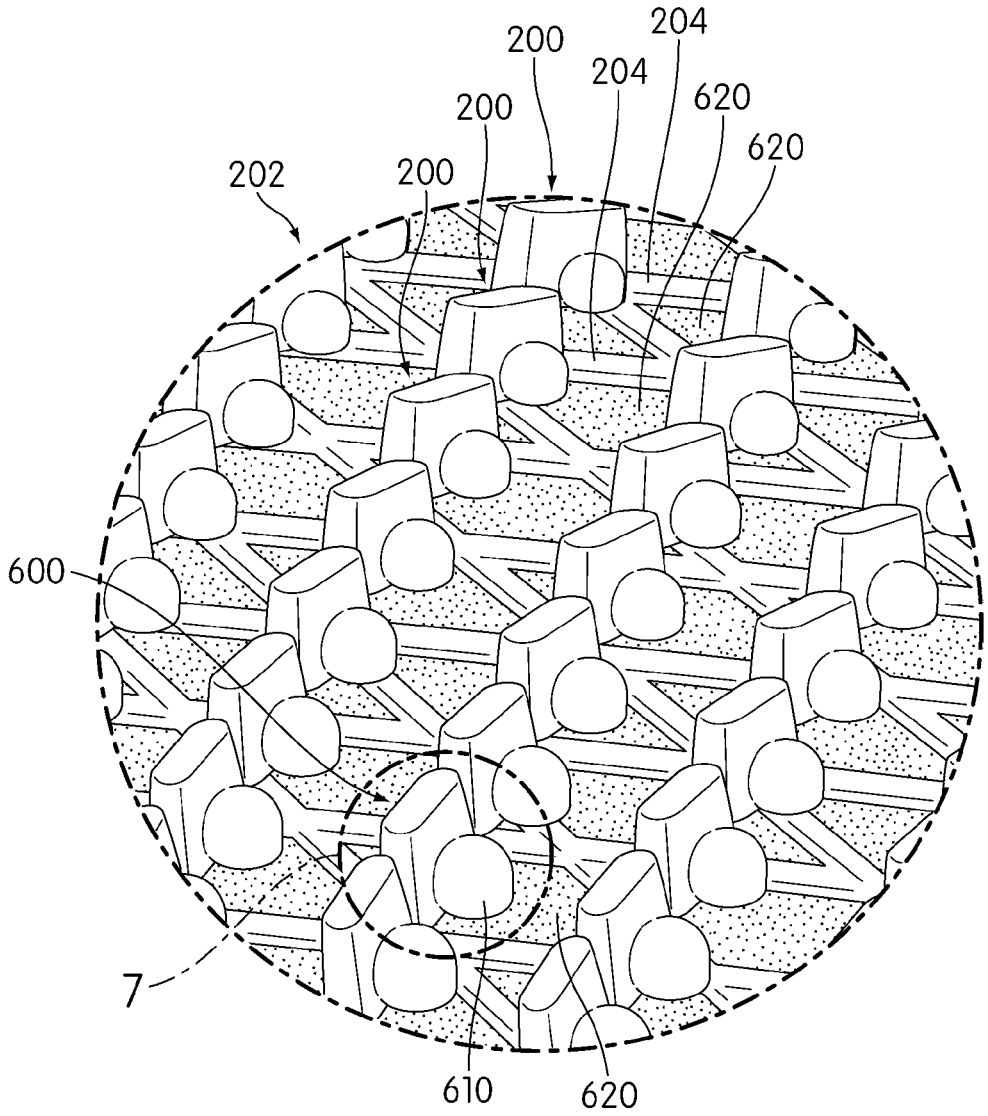
FIG. 6 is an enlarged view of an embodiment of a ball control portion.

FIG. 6 illustrates an enlarged view of a portion of lattice 202 forming ball control portion 120. In this embodiment, lattice 202 includes plurality of protrusions 200. Plurality of protrusions 200 may include one or more individual protrusions, including a first protrusion 600. Plurality of protrusions 200 may be connected to one another by connecting members 204. Furthermore, plurality of protrusions 200 and connecting members 204 may be spaced apart by gaps 620. This arrangement may provide a web-like configuration for lattice 202. In other embodiments, however, lattice 202 may comprise a substantially solid layer without gaps 620.

In different embodiments, gaps 620 may have varying shapes including, but not limited to: rounded shapes (such as circular or oval shapes), polygonal shapes (such as triangular, rectangular, pentagonal, etc.), regular shapes, irregular shapes, or any other types of shapes. In some cases, gaps 620 may have substantially similar shapes to one another. In other cases, different gaps of gaps 620 may have substantially different shapes. Furthermore, in some cases, gaps 620 may have shapes that correspond to the shapes of plurality of protrusions 200. In other cases, however, gaps 620 may have different shapes from plurality of protrusions 200. In the current embodiment, gaps 620 may have substantially diamond shapes that correspond to the arrangement of plurality of protrusions 200. In other embodiments, however, gaps 620 may have any other shapes including any of the shapes discussed above.

In some embodiments, lattice 202 may be disposed on a substrate layer of article 100. In one embodiment, the substrate layer may be exposed in gaps 620 between portions of lattice 202. In an exemplary embodiment, the substrate layer may be constructed of a resilient foam material. In different embodiments, the substrate layer may be constructed from any materials, including materials discussed above for constructing article 100 and/or upper 102. In an exemplary embodiment, the substrate layer may be provided on portions of article 100 including ball control portion 120 so that lattice 202 may be disposed approximately flush with upper 102 and/or underside 300. In other embodiments, the substrate layer may include upper 102 and/or substantially the same materials as the materials used to construct upper 102. In different embodiments, the substrate layer may be provided on article 100 so that lattice 202 may be disposed above the surface of upper 102 and/or underside 300.

Using the arrangement discussed above, the structural properties of lattice 202 may be varied. For example, by varying the size, shape and number of gaps 620 in lattice 202, the rigidity of lattice 202 may be varied. In addition, by increasing the number of gaps, and thus decreasing the material comprising base lattice 202, the overall weight of lattice 202 may be reduced to help minimize additional weight on article 100.

In some embodiments, lattice 202 may include additional elements for the purposes of providing additional rigidity to portions of lattice 202. In some cases, additional elements may provide rigidity to one or more of the plurality of protrusions 200. In an exemplary embodiment, a supporting member 610 may provide additional rigidity to first protrusion 600. In some cases, supporting member 610 may provide support to first protrusion 600 along a direction that first protrusion 600 may be configured to bend. In this embodiment, supporting member 610 may be disposed behind one side of first protrusion 600 in gap 620. In other cases, supporting member 610 may be disposed behind one or more sides of first protrusion 600.

In an exemplary embodiment, supporting member 610 may be formed integrally with lattice 202. In one embodiment, supporting member 610 may be formed together with one or more of the plurality of protrusions 200, including first protrusion 600. In this embodiment, supporting member 610 is formed with the same material as first protrusion 600. In other embodiments, supporting member 610 may be formed separately from plurality of protrusions 200. In one embodiment, supporting member 610 may be formed integrally with one or more connecting members 204. In other embodiments, supporting member 610 may be formed separately from lattice 202, plurality of protrusions 200, and/or connecting members 204. Additionally, supporting member 610 may be constructed of the same or different materials as any of lattice 202, plurality of protrusions 200, and/or connecting members 204.

In some embodiments, supporting member 610 may have a generally spheroid shape. In other embodiments, supporting member 610 may have any shape configured to provide support, including, but not limited to: rounded shapes (such as circular or oval shapes), polygonal shapes (such as triangular, rectangular, pentagonal, etc.), regular shapes, irregular shapes, or any other types of shapes. In an exemplary embodiment, ball control portion 120 may include a plurality of supporting members substantially identical to supporting member 610. In other embodiments, ball control portion 120 may include one or more supporting members with different shapes. In some cases, the size and/or height of a supporting member may be configured to provide more or less rigidity to an individual protrusion. In other cases, multiple supporting members may be associated with an individual protrusion to provide additional support. In still other cases, one supporting member may be configured to provide support to more than one protrusion.

Figure 7:
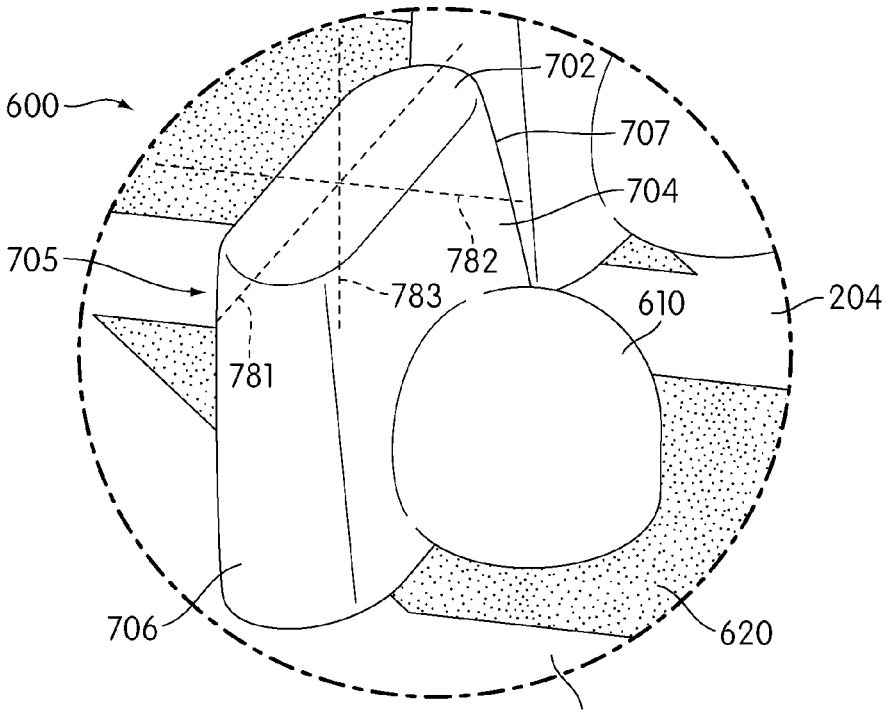
FIG. 7 is an enlarged view of an embodiment of a protrusion associated with a ball control portion.

FIG. 7 illustrates an isolated view of first protrusion 600 for purposes of illustrating the geometry of plurality of protrusions 200. Referring to FIG. 7, for purposes of description, first protrusion 600 may be associated with major axis 781, minor axis 782 and normal axis 783 in the manner described above. In some cases, first protrusion 600 may include first major face 704 and second major face 705, which is disposed opposite of first major face 704. First major face 704 and second major face 705 may form sidewalls for first protrusion 600. In particular, include first major face 704 and second major face 705 are approximately planar surfaces that extend along major axis 781 and normal axis 783 of first protrusion 600. In other embodiments, however, include first major face 704 and second major face 705 may be substantially curved surfaces.

First protrusion 600 may also include a first side edge 706 and a second side edge 707 that extend along minor axis 782 between first major face 704 and second major face 705. In some cases, first side edge 706 and second side edge 707 may be approximately planar edges. In other cases, however, first side edge 706 and second side edge 707 may be approximately rounded edges. In addition, first protrusion 600 may include top surface 702 that extends along major axis 781 and minor axis 782 at an outward most end of first protrusion 600. In some cases, top surface 702 may be an approximately planar top surface that presents a flat end for first protrusion 600. In other cases, however, top surface 702 may be a rounded surface.

In different embodiments, the dimensions of first protrusion 600 may vary. In an exemplary embodiment, the length of first protrusion 600, which is associated with major axis 781, may be substantially larger than the width, which is associated with minor axis 782. Likewise, the height of first protrusion 600, which is associated with normal axis 783, may be substantially larger than the width. Still further, the length may be substantially larger than the height. With this arrangement for the dimensions of first protrusion 600, first major face 704 and second major face 705 may comprise a majority of the surface area of first protrusion 600.

Figure 8:
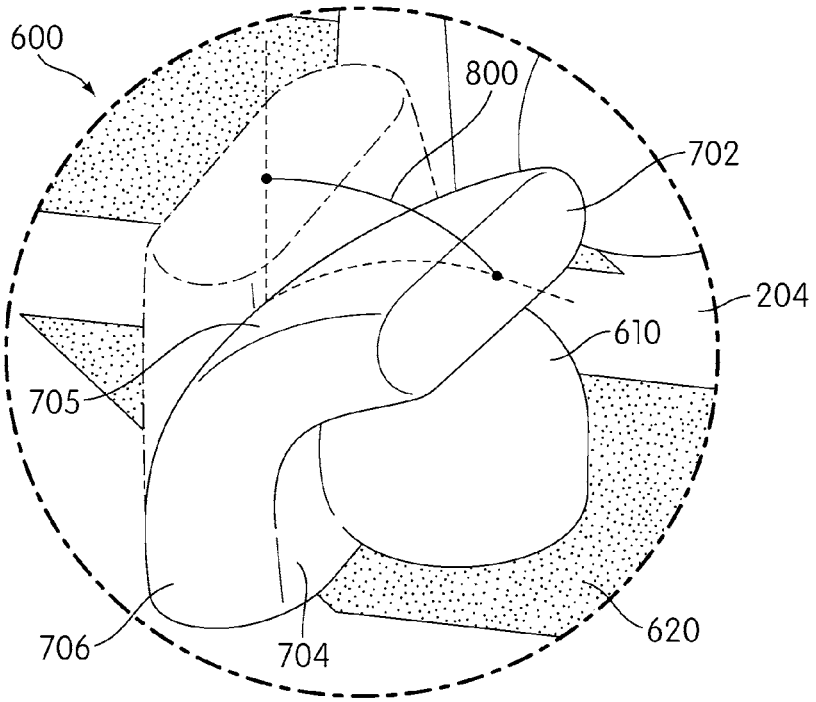
FIG. 8 is an enlarged schematic view of an embodiment of a protrusion associated with a ball control portion bending.

Referring now to FIG. 8, in some embodiments, first protrusion 600 may be configured to bend. In some cases, first protrusion 600 may be configured to bend about an axis approximately parallel to major axis 781. In other words, first protrusion 600 may be configured to bend in a manner that disposes either first major face 704 or second major face 705 closer to the outer surface of upper 102. For example, in one direction of bending, first major face 704 may approximately confront supporting member 610. Furthermore, in this case, second major face 705 may be oriented to face outwardly and away from upper 102. In addition, in a second direction of bending, second major face 705 may approximately confront lattice 202. Furthermore, in this case, first major face 704 may be oriented to face outwardly and away from upper 102. With this arrangement, as first protrusion 600 bends, either first major face 704 or second major face 705 are exposed outwardly from upper 102. This arrangement may increase the surface area of first protrusion 600 that is exposed outwardly on upper 102, which can help increase grip on a ball during kicks, for example.

In some embodiments, supporting member 610 may provide additional rigidity to first protrusion 600 in one direction of bending. In an exemplary embodiment, first major face 704 may approximately confront supporting member 610 in one direction of bending. In this embodiment, supporting member 610 may provide support to first protrusion when bending in one direction. With this arrangement, supporting member 610 may provide additional rigidity to first protrusion 600 when bending in a direction of supporting member 610. In some embodiments, the size and/or height of supporting member 610 may be configured to allow a desired degree of bending of first protrusion 600. In this embodiment, supporting member 610 may be configured to allow first protrusion 600 to bend to a first angle 800. In other cases, ball control portion 120 may not include supporting member 610 and first major face 704 and second major face 705 of first protrusion 600 may bend substantially similar amounts in each respective direction.

It will be understood that the discussion above for first protrusion 600 may be applied to any protrusion of plurality of protrusions 200. In other words, the general geometry of each protrusion of plurality of protrusions 200 may be substantially similar to the geometry described for first protrusion 600. In addition, each protrusion of plurality of protrusions 200 may be provided with at least one major face that is configured to contact a ball. Furthermore, each protrusion may be configured to bend in a similar manner about a major axis of the protrusion so as to expose a major face outwardly on upper 102.

A ball control portion including protrusions may include provisions for improving contact with a ball during kicks. In some embodiments, ball control portion 120 may be selectively applied to portions of article 100 that impact a ball during various types of kicks. In one embodiment, ball control portion 120 including plurality of protrusions 200 may be selectively applied to a predetermined kicking region of article 100. The term "predetermined kicking region" as used throughout this detailed description and in the claims refers to a region of an article that is configured to impact a ball during a predetermined type of kick. For example, in a free kick situation in soccer, a player may want to put sidespin on the ball in order to curve the trajectory of the ball. This type of kick is often referred to as a "banana kick," and is useful for kicking the ball at a target that is on the other side of an obstruction, such as an opposing player. In order to apply sidespin to the ball, the play may kick the ball off center using the medial side, or instep of the upper. Therefore, in some embodiments, ball control portion 120 may include plurality of protrusions 200 that are disposed on the instep of the upper to facilitate a kick in which sidespin is applied to the ball.

Figure 9:
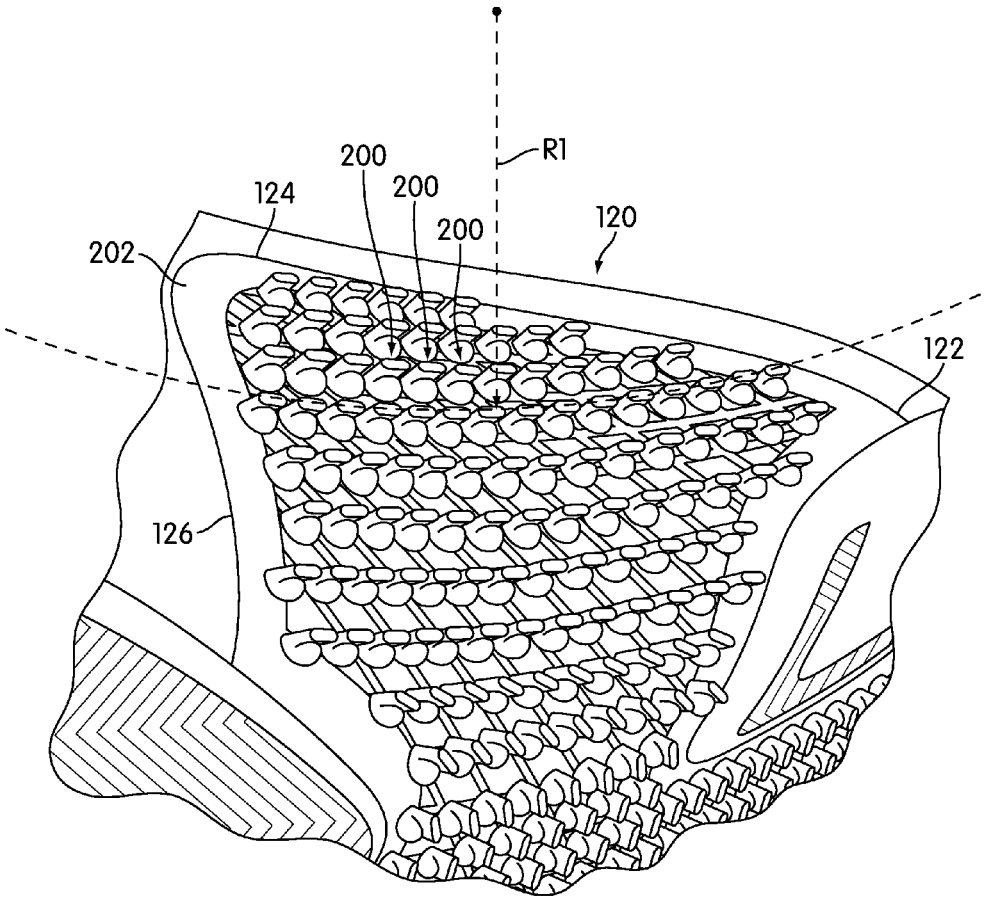
FIG. 9 is an enlarged schematic view of a contour of a midfoot region of a ball control portion.
Figure 10:
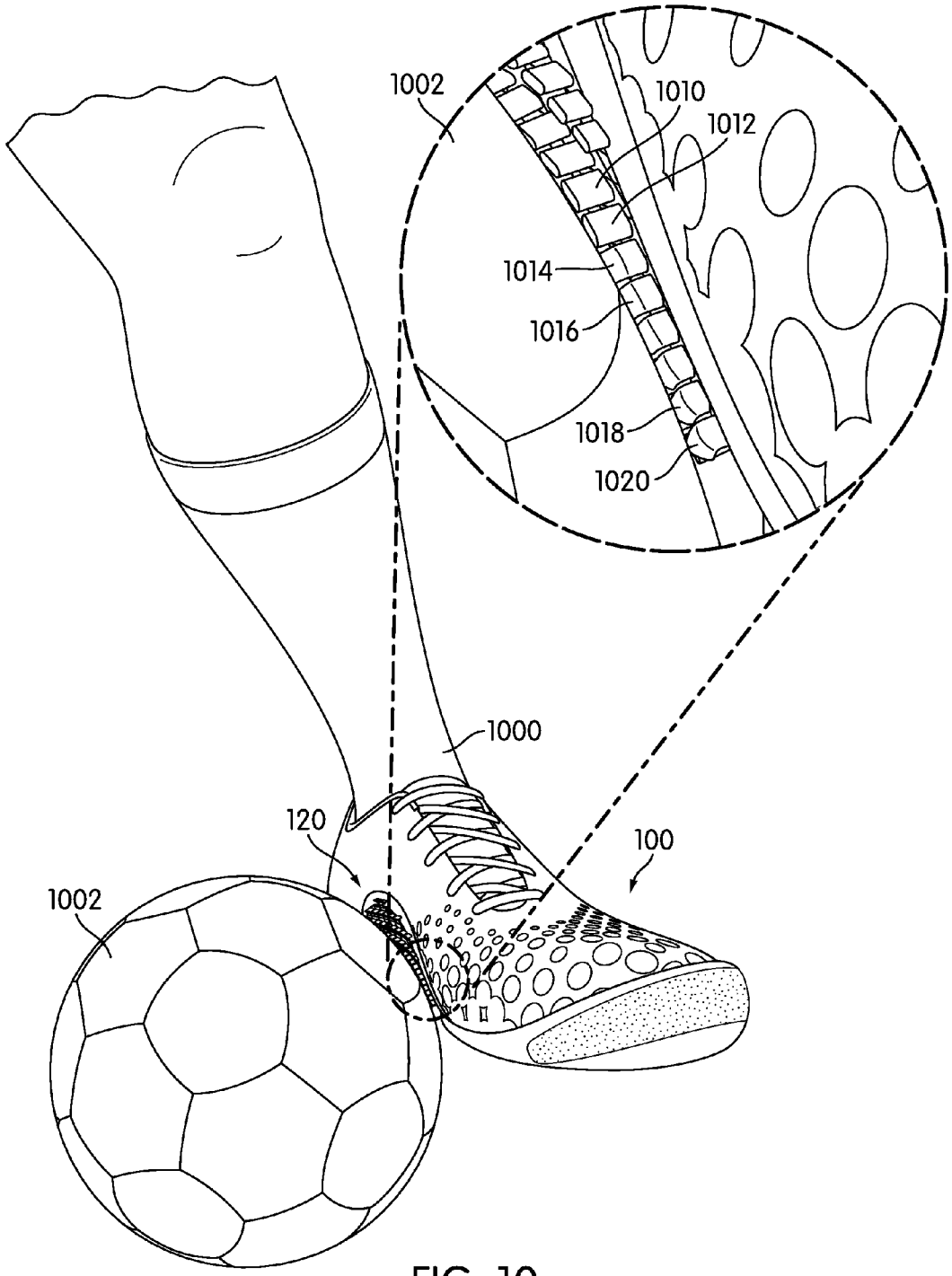
FIG. 10 is a representative view of an embodiment of a ball being kicked using a ball control portion.

Referring to FIGS. 9 and 10, in the current embodiment, plurality of protrusions 200 may arranged on a predetermined kicking region of ball control portion 120. In some embodiments, the predetermined kicking region may be disposed on medial side 16 of upper 102. Furthermore, the predetermined kicking region may extend along ball control portion 120 from medial front edge 122 to medial rear edge 126 in midfoot region 12. In some embodiments, the predetermined kicking region of ball control portion 120 may correspond to an arch of a foot of a wearer. In the current embodiment, the predetermined kicking region may include the instep of upper 102 as well as adjacent areas to the instep. With this arrangement, plurality of protrusions 200 may be disposed on portions of article 100 that are most likely to contact a ball during a medial side kick.

Plurality of protrusions 200 of ball control portion 120 may be oriented in a manner that increases the contact area between plurality of protrusions 200 and a rounded surface such as a ball. In some embodiments, plurality of protrusions 200 may be arranged in a curved configuration that corresponds to the natural curvature of a ball surface, which is approximately spherical. In one embodiment, plurality of protrusions 200 may be arranged in an arc-like configuration. The term "arc" as used throughout this detailed description and in the claims refers to any segment of a curve. In some cases, an arc may be a segment of a circle. In other cases, however, an arc may be a segment of any other type of curve.

In one embodiment, plurality of protrusions 200 may be arranged in an arc-like configuration at midfoot region 12 of article 100. In some embodiments, one or more portions of ball control portion 120 may be configured to have a contour along the surface of article 100. In one embodiment, plurality of protrusions 200 may be arranged within lattice 202 of ball control portion 120 to have a contoured shape along the outer surface of article 100. In an exemplary embodiment, the contoured shape of ball control portion 120 in midfoot region 12 of medial side 16 may be configured to generally correspond to the contour of an arch of a foot of a wearer.

As shown in FIG. 9, the contour of ball control portion 120 at midfoot region 12 of medial side 16 in this embodiment may correspond to a generally concave contour associated with a first radius R1. In other embodiments, the contour may be generally convex. In some cases, first radius R1 may correspond to the approximate curvature of an arch of a foot of a wearer. In other cases, first radius may correspond to the natural curvature of a ball surface, which is approximately spherical. In some cases, first radius R1 may be a segment of a circle. In other cases, however, first radius R1 may be a segment of any other type of curve.

In some embodiments, the arc-like configuration of plurality of protrusions 200 and/or contour of ball control portion 120 may have a configuration that corresponds to the curvature of a generally spherical ball. For example, in one embodiment, the arc-like configuration of plurality of protrusions 200 and/or contour of ball control portion 120 may correspond to the curvature of a soccer ball. In particular, the shape and size of the arc-like configuration of plurality of protrusions 200 and/or contour of ball control portion 120 may be selected so that as a ball contacts the predetermined kicking region, plurality of protrusions 200 may be substantially tangent to an outer surface of the ball. It will be understood that in other embodiments, the arc-like configuration of plurality of protrusions 200 and/or contour of ball control portion 120 may correspond to the shapes of different shapes and/or sizes of balls. For example, in another embodiment, the arc-like configuration of plurality of protrusions 200 and/or contour of ball control portion 120 may have a size and shape that correspond to the curvature of a football that is used in American football. In still another embodiment, the arc-like configuration of plurality of protrusions 200 and/or contour of ball control portion 120 may have a size and shape that corresponds to the curvature of a ball that is used in rugby.

FIG. 10 illustrates an embodiment of a foot 1000 of an athlete kicking a ball 1002. In particular, as shown, the athlete is intending to kick ball 1002 in a manner that imparts sidespin to ball 1002 so that the trajectory of ball 1002 may be curved. Although the current embodiment illustrates a kick performed using a medial side of a left foot, in other embodiments the athlete may use the medial side of a right foot to perform a similar type of kick.

Ball control portion 120 on article 100 may contact an outer surface of ball 1002. More specifically, ball 1002 may contact plurality of protrusions 200 of ball control portion 120. Under the force of impact between ball control portion 120 and ball 1002, plurality of protrusions 200 may bend. In some embodiments, as the motion of foot 1000 is sideways as well as vertically upwards, plurality of protrusions 200 may bend or deflect downwards. In one embodiment, plurality of protrusions 200 may be bent towards an outer surface of article 100.

In an exemplary embodiment, for purposes of illustrating the bending of plurality of protrusions 200 when contacting ball 1002, plurality of protrusions 200 may include a first protrusion 1010, a second protrusion 1012, a third protrusion 1014, a fourth protrusion 1016, a fifth protrusion 1018, and a sixth protrusion 1020. In this embodiment, a number of protrusions disposed towards forefoot region 10 of article 100 may confront the surface of ball 1002. In the current embodiment, third protrusion 1014, fourth protrusion 1016, fifth protrusion 1018, and sixth protrusion 1020 may bend when contacting ball 1002. In this embodiment, ball 1002 has arrived at article 100 in a direction from forefoot region 10 and towards heel region 14. Accordingly, in this embodiment, ball 1002 has contacted third protrusion 1014, fourth protrusion 1016, fifth protrusion 1018, and sixth protrusion 1020, but has not contacted first protrusion 1010 and/or second protrusion 1012.

Additionally, in some embodiments, each protrusion may bend in correspondence to the amount of force received when contacting ball 1002. In some cases, the amount of force received when contacting ball 1002 may vary as a function of the speed and direction of ball 1002 when contacting article 100. In this embodiment, where ball 1002 has arrived in a direction from forefoot region 10 and towards heel region 14, sixth protrusion 1020 and/or fifth protrusion 1018 may bend to a greater degree than fourth protrusion 1016 and/or third protrusion 1014. In other cases, one or more protrusions on ball control portion 120 may be configured to bend more or less in different regions of ball control portion 120.

Furthermore, because of the flexibility of plurality of protrusions 200, third protrusion 1014, fourth protrusion 1016, fifth protrusion 1018, and sixth protrusion 1020 may conform to ball 1002 in a manner that maximizes the surface contact area between one or more major faces of each protrusion and the surface of ball 1002. In contrast to situations where a ball may only contact a small region of an upper, the current embodiment provides flexible protrusions that bend in a manner to create a greater surface contact area between article 100 and ball 1002.

In addition, as illustrated in FIG. 10, the contoured shape of ball control portion 120 in the current embodiment may correspond to the curvature of ball 1002. This arrangement may facilitate increased grip between ball control portion 120 and ball 1002, as an athlete continues the kicking motion. In particular, the vertical component of the kicking motion is applied to the surface of ball 1002 due to the enhanced grip provided by ball control portion 120. This arrangement acts to add rotation, or sidespin, to ball 1002 as ball 1002 is kicked forwards.

Because plurality of protrusions 200 are longer in one direction than they are the other, plurality of protrusions 200 may change characteristics depending on how the ball is kicked. The spin put on a ball by kicking at one angle may differ from the spin put on a ball by kicking at another angle. Further, because plurality of protrusions 200 provide a flexible and adaptable surface, plurality of protrusions 200 may adapt to accommodate a particular user and particular kinds of kicks.

Although the current embodiment discusses the use of plurality of protrusions 200 for applying side spin to a ball during a particular type of kick, in other embodiments plurality of protrusions 200 may be used to apply other types of spin to a ball as well. In particular, the orientation and location of a plurality of protrusions may be varied to facilitate applying different types of spin to a ball for different types of kicks. For example, in other cases, a plurality of protrusions may be used to apply sidespin, topspin, backspin as well as other types of spin to a ball. In addition, in other embodiments, a plurality of protrusions may be used to enhance grip between an upper and a ball for other purposes as well. For example, in another embodiment, a plurality of protrusions may help enhance grip between a ball and an upper for purposes of receiving or making a pass. In still another example, a plurality of protrusions may be used to enhance grip between a ball and an upper for purposes of performing special maneuvers such as bicycle kicks or heel kicks.

The current embodiment illustrates a ball control portion disposed on a medial side of an article, however, in other embodiments a ball control portion comprising a plurality of protrusions could be associated with any other region of an article, including any other predetermined kicking region that is associated with a predetermined type of kick. For example, in one embodiment, a ball control portion could be disposed on a lateral side of an upper for kicking a ball with a lateral side of the upper. In another embodiment, a ball control portion could be disposed on a heel portion of the upper for performing heel kicks or rainbow kicks.

In some embodiments, ball control portion 120 may be disposed on underside 300 and/or lateral side 18 of article 100. In this embodiment, plurality of protrusions 200 may apply different types of spin and/or other characteristics when contacting ball 1002. In one embodiment, ball control portion 120 disposed on underside 300 of article 100 may include plurality of protrusions 200 arranged to trap ball 1002 against a ground surface. In other embodiments, ball control portion 120 disposed on lateral side 18 of article 100 may include plurality of protrusions 200 arranged to apply different types of spin to ball 1002 when hit with the lateral side of a foot.

Figure 11:
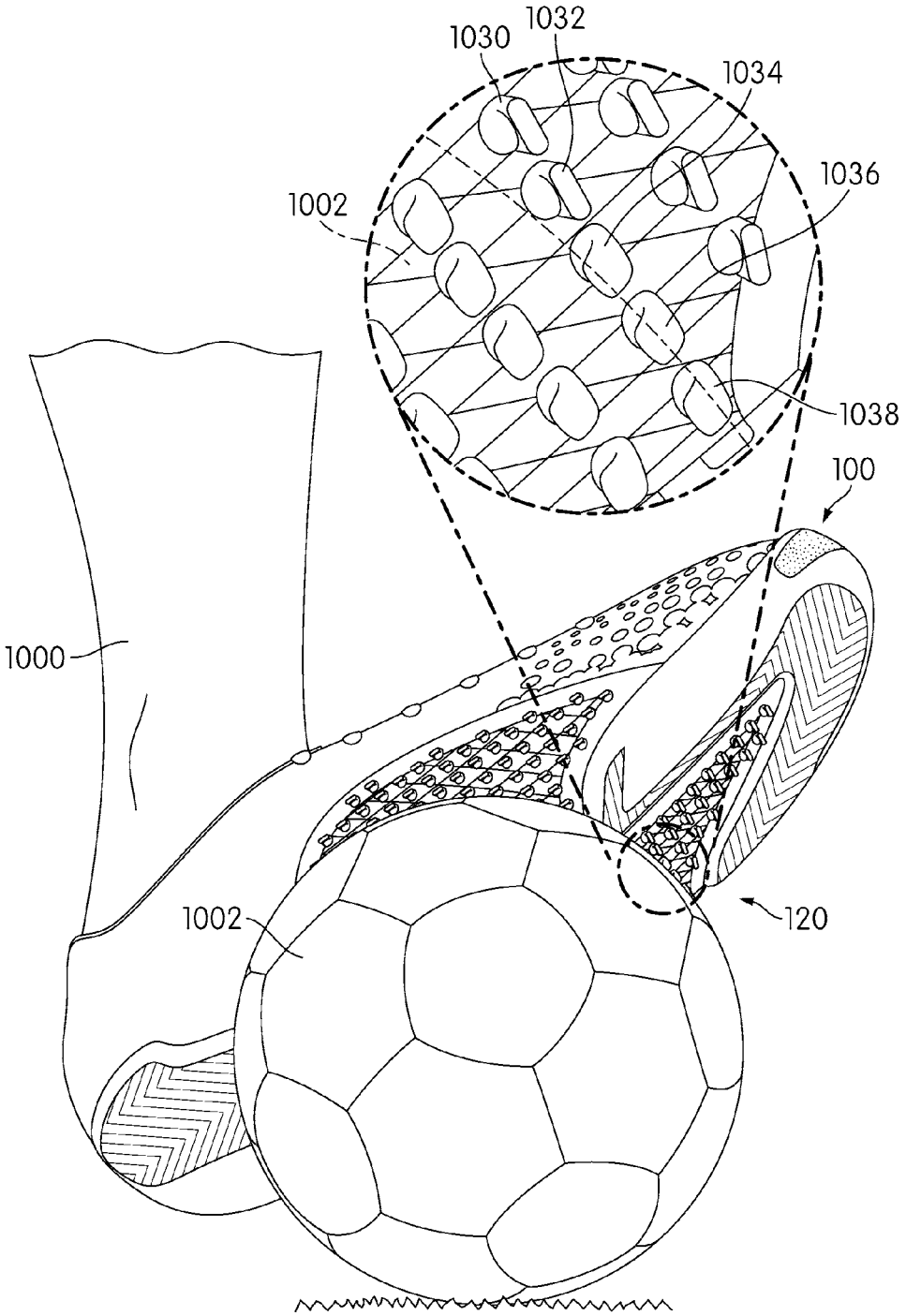
FIG. 11 is a representative view of an embodiment of a ball being trapped against the ground using a ball control portion.

FIG. 11 illustrates an embodiment of a foot 1000 of an athlete trapping a ball 1002. In particular, as shown, the athlete is applying weight from foot 1000 disposed in article 100 to ball 1002, trapping ball 1002 between ball control portion 120 and a ground surface. Although the current embodiment illustrates a trap performed using an underside of an article associated with a left foot, in other embodiments the athlete may use the underside of a right foot to perform a similar type of maneuver.

In some embodiments, ball control portion 120 disposed on underside 300 of article 100 may contact an outer surface of ball 1002. More specifically, ball 1002 may contact a plurality of protrusions of ball control portion 120. By applying weight from a foot of a wearer to article 100, ball 1002 may be trapped between ball control portion 120 and the ground surface. In an exemplary embodiment, for purposes of illustrating the bending of plurality of protrusions 200 when trapping ball 1002, plurality of protrusions 200 may include a first protrusion 1030, a second protrusion 1032, a third protrusion 1034, a fourth protrusion 1036, and a fifth protrusion 1038. In this embodiment, a number of protrusions disposed on ball control portion 120 on underside 300 of article 100 may confront the surface of ball 1002. In the current embodiment, third protrusion 1034, fourth protrusion 1036, and fifth protrusion 1038 may bend when trapping ball 1002. In this embodiment, ball 1002 has arrived at article 100 in a direction from forefoot region 10 and towards heel region 14. Accordingly, in this embodiment, ball 1002 may be trapped by third protrusion 1034, fourth protrusion 1036, and fifth protrusion 1038, but has not contacted first protrusion 1030 and/or second protrusion 1032.

Furthermore, because of the flexibility of plurality of protrusions 200, third protrusion 1034, fourth protrusion 1036, and fifth protrusion 1038 may conform to ball 1002 in a manner that maximizes the surface contact area between one or more major faces of each protrusion and the surface of ball 1002. With this arrangement, ball 1002 may be trapped between article 100 and the ground surface. In contrast to situations where a ball may only contact the underside of an article, the current embodiment provides flexible protrusions that bend in a manner to create a greater surface contact area between article 100 and ball 1002 for trapping ball 1002 to the ground surface.

In the exemplary embodiment illustrated in FIG. 11, plurality of protrusions 200 of ball control portion 120 on underside 300 of article 100 are shown bending in a direction towards heel region 14 to trap ball 1002. In other embodiments, one or more of plurality of protrusions 200 of ball control portion 120 on underside 300 of article 100 may bend in different directions when contacting ball 1002. In one embodiment, plurality of protrusions 200 of ball control portion 120 on underside 300 of article 100 may bend in a direction towards forefoot region 10 to trap ball 1002.

In some embodiments, different types of spin may be imparted to ball 1002 by using plurality of protrusions 200 arranged with specific orientations. In one embodiment, ball control portion 120 disposed in different regions of article 100 may include one or more groups of plurality of protrusions 200 oriented in a particular direction. In one embodiment, different portions of ball control portion 120 may include two or more groups of plurality of protrusions 200 oriented in different directions.

Figure 12:
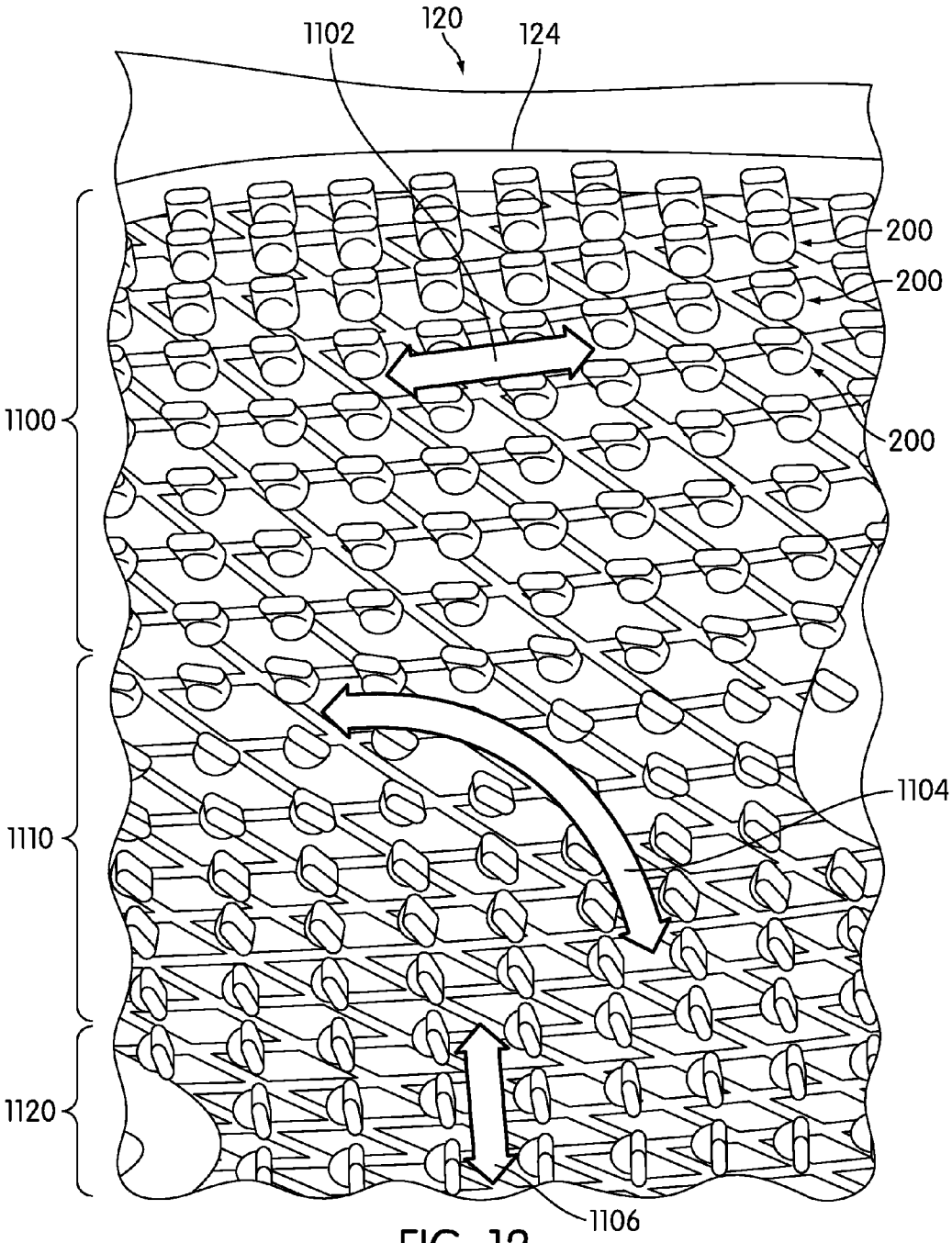
FIG. 12 is an enlarged schematic view of an embodiment of a side of an article of footwear including a ball control portion with a plurality of protrusions oriented in different directions.

Referring now to FIG. 12, ball control portion 120 disposed at midfoot region 12 may include multiple groups of protrusions oriented in different directions. In particular, a first group of protrusions 1100 of plurality of protrusions 200, which are disposed at midfoot region 12 near medial midsection edge 124 on medial side 16, may be oriented in a first direction 1102. A second group of protrusions 1110 of plurality of protrusions 200, which are disposed at midfoot region 12 extending between medial side 16 and underside 300, may be oriented in a second direction 1104. Also, a third group of protrusions 1120 of plurality of protrusions 200, which are disposed at midfoot region 12 of underside 300, may be oriented in a third direction 1106. In other words, the major axis of each protrusion associated with first group of protrusions 1100 may be oriented approximately in first direction 1102. Likewise, the major axis of each protrusion associated with second group of protrusions 1110 may be oriented approximately in second direction 1104. Similarly, the major axis of each protrusion associated with third group of protrusions 1120 may be oriented approximately in third direction 1106. It will be understood that first direction 1102, second direction 1104, and third direction 1106 are only intended to indicate average directions.

In particular, although the major axis of each protrusion of first group of protrusions 1100 may be oriented in slightly different directions from one another, first direction 1102 may characterize the overall direction, or average direction, of the protrusions of first group of protrusions 1100. Similarly, although the major axis of each protrusion of second group of protrusions 1110 and third group of protrusions 1120 may be oriented in slightly different directions from one another, second direction 1104 and third direction 1106 may characterize the overall direction, or average direction, of the protrusions of, respectively, second group of protrusions 1110 and third group of protrusions 1120. Still further, the protrusions disposed between first group of protrusions 1100, second group of protrusions 1110, and/or third group of protrusions 1120 may be oriented in a manner that continuously varies between first direction 1102, second direction 1104, and/or third direction 1106.

In some cases, first direction 1102 may be substantially similar to second direction 1104 and/or third direction 1106. In addition, second direction 1104 may be substantially similar to third direction 1106. In other cases, however, first direction 1102 may be a substantially different direction than either or both second direction 1104 and third direction 1106. Similarly, second direction 1104 may be a substantially different direction than third direction 1106. For example, in one embodiment, first direction 1102 may be a direction oriented close to a longitudinal direction, while third direction 1104 may be a direction oriented close to a lateral direction. In an exemplary embodiment, second direction 1104 may be a direction oriented between first direction 1102 and third direction 1106.

Figure 13:
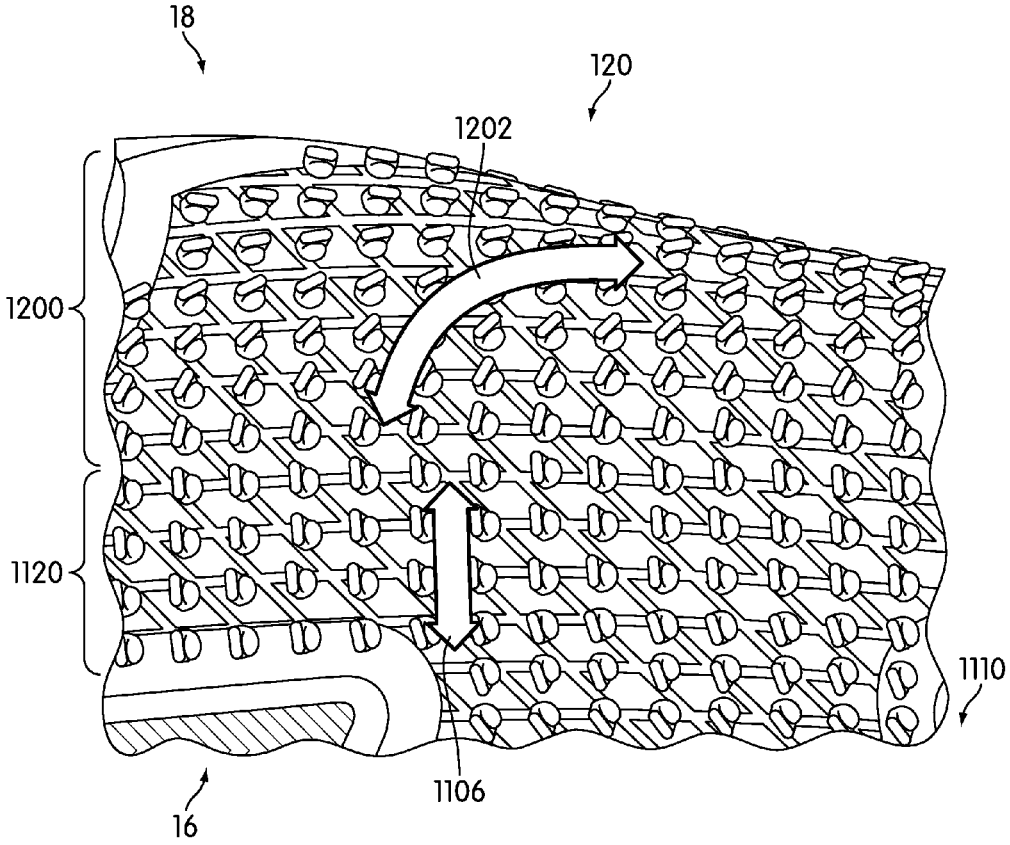
FIG. 13 is an enlarged schematic view of an embodiment of an underside of an article of footwear including a ball control portion with a plurality of protrusions oriented in different directions.

Referring now to FIG. 13, in some embodiments, ball control portion 120 may extend into a portion of underside 300 of article 100. In this embodiment, ball control portion 120 disposed at midfoot region 12 of underside 300 may include multiple groups of protrusions oriented in different directions, as described above. In particular, ball control portion 120 on underside 300 may include third group of protrusions 1120 oriented in third direction 1106. In some embodiments, ball control portion 120 on underside 300 may include a fourth group of protrusions 1200 of plurality of protrusions 200. Fourth group of protrusions 1200, which may be associated with a lateral portion of underside 300 near lateral side 18, may be oriented in a fourth direction 1202. In other words, the major axis of each protrusion associated with fourth group of protrusions 1200 may be oriented approximately in fourth direction 1202. It will be understood that fourth direction 1202 is only intended to indicate an average direction. Similarly, as described above in regard to FIG. 12, while the major axis of each protrusion of fourth group of protrusions 1200 may be oriented in slightly different directions from one another, fourth direction 1202 may characterize the overall direction, or average direction, of the protrusions of fourth group of protrusions 1200.

In some cases, the protrusions of fourth group of protrusions 1200 may be oriented in a manner that continuously varies across ball control portion 120. In one embodiment, the protrusions of fourth group of protrusions 1200 may vary from a direction generally oriented in a direction substantially similar to third direction 1106 at a portion of ball control portion 120 located adjacent to third group of protrusions 1120 to a direction generally oriented in a direction approximately perpendicular to third direction 1106 at a portion of ball control portion 120 located adjacent to an edge of lateral side 18.

Using the arrangements discussed above, ball control portion 120 may be configured to increase grip between a ball and various different regions of article 100. In particular, by applying a plurality of protrusions to selective regions of ball control portion 120 on article 100 corresponding to regions that impact a ball during predetermined types of kicks, ball control portion 120 may be used to enhance the ability of an athlete to apply spin for curving the trajectory of a ball. Still further, by arranging different groups of plurality of protrusions with orientations in different directions, ball control portion 120 may be enhanced for more precise control of the ball trajectory.

In some embodiments, ball control portion 120 may include substantially similar types of protrusions disposed across the surface of ball control portion 120. In other embodiments, ball control portion 120 may include one or more different types of protrusions disposed across the surface of ball control portion 120. In an exemplary embodiment, different types of protrusions may be arranged at various portions of ball control portion 120 to impart different characteristics to a ball when contacted by ball control portion 120. In one embodiment, one or more different types of protrusions may be associated with any of ball control portion 120 on medial side 16, lateral side 18, and/or underside 300 of article 100.

Figure 14:
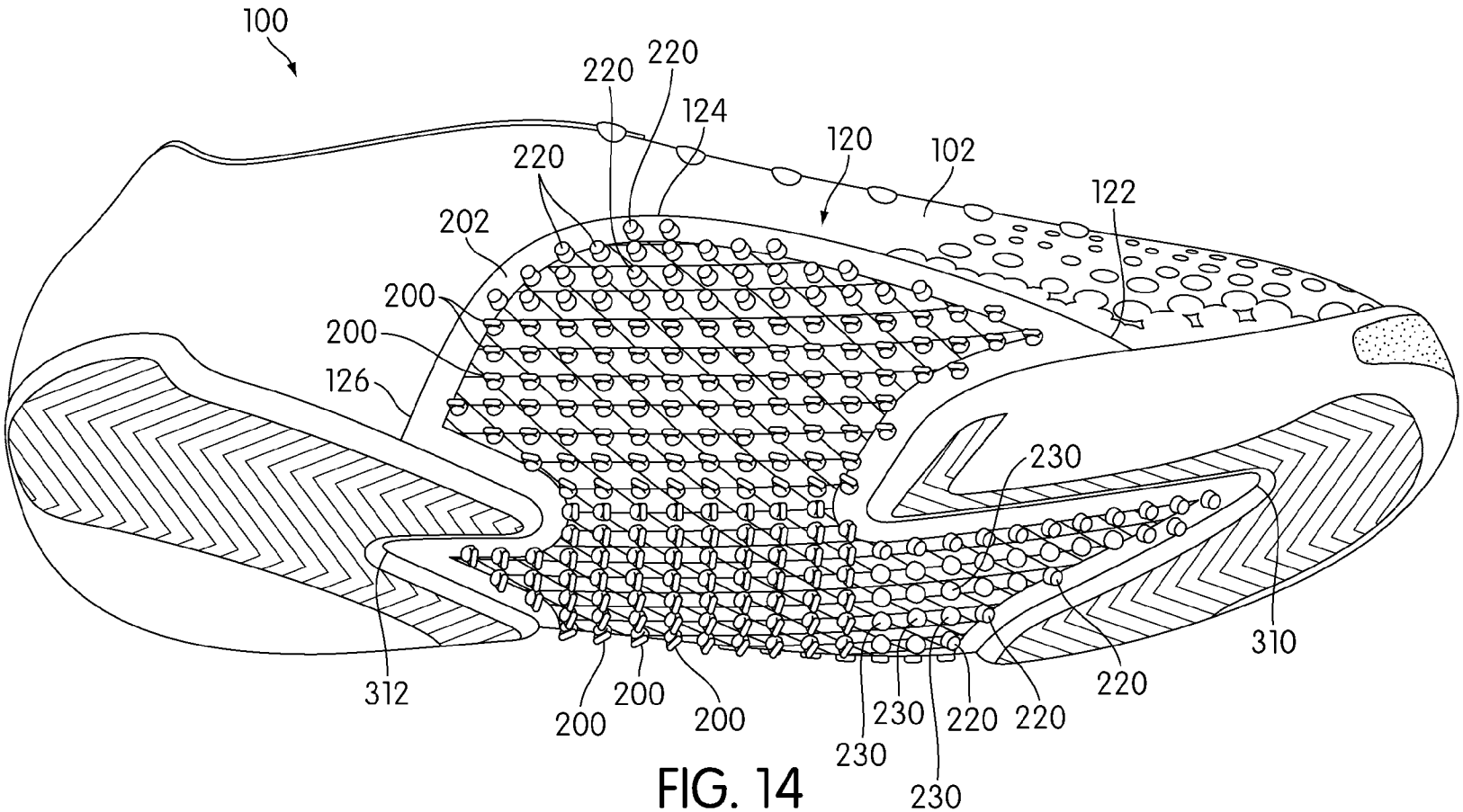
FIG. 14 is an isometric view of an alternate embodiment of an article of footwear including a ball control portion with multiple types of protrusions disposed over a side and an underside.

Referring now to FIG. 14, an exemplary embodiment of article of footwear 100 with ball control portion 120 associated with medial side 16 and underside 300 may include one or more different types of protrusions. In this embodiment, ball control portion 120 may be disposed over a portion of medial side 16 and a portion of underside 300 in a substantially similar manner as described above in regard to FIG. 5. In this embodiment, plurality of protrusions 200 may be a first type of protrusion, as described above. Ball control portion 120 may also include a second plurality of protrusions 220. Second plurality of protrusions 220 may be a second type of protrusion, different from the first type of protrusion. Additionally, in this embodiment, ball control portion 120 also may include a third plurality of protrusions 230. Third plurality of protrusions 230 may be a third type of protrusion, different from the first type of protrusion and/or the second type of protrusion.

In some embodiments, different types of protrusions may be located at various portions of ball control portion 120 to provide different characteristics when contacting a ball. In an exemplary embodiment, second plurality of protrusions 220 may be generally more rigid than plurality of protrusions 200. With this arrangement, second plurality of protrusions 220 may be arranged to assist with passing a ball. In one embodiment, ball control portion 120 may include a portion on medial side 16 located adjacent to medial midsection edge 124 containing second plurality of protrusions 220. In this embodiment, second plurality of protrusions 220 are disposed on lattice 202 in four rows beginning at medial midsection edge 124 and extending down on ball control portion 120 towards the bottom of article 100. In other embodiments, second plurality of protrusions 220 may be disposed on lattice 202 in various arrangements, including in any number of rows, columns, and/or interspersed with one or more other types of protrusions.

In some embodiments, ball control portion 120 may include a portion containing multiple different types of protrusions. In one embodiment, ball control portion 120 may include a portion on underside 300 located adjacent to forefoot edge 310 containing second plurality of protrusions 220 and third plurality of protrusions 230. In this embodiment, second plurality of protrusions 220 and third plurality of protrusions 230 are different types of protrusions. In addition, both second plurality of protrusions 220 and third plurality of protrusions 230 may be different types of protrusions than the type of protrusion associated with plurality of protrusions 200 disposed over the majority of ball control portion 120.

In an exemplary embodiment, second plurality of protrusions 220 may be disposed on lattice 202 closer to forefoot edge 310 than third plurality of protrusions 230. Third plurality of protrusions 230 may be disposed on lattice 202 between second plurality of protrusions 220 adjacent to forefoot edge 310 and plurality of protrusions 200 disposed over ball control portion 120. In other embodiments, second plurality of protrusions 220 and/or third plurality of protrusions 230 may be disposed over more or less of ball control portion 120 in various portions. With this arrangement, different types of protrusions may be arranged on various portions of ball control portion 120 to provide different characteristics when contacting a ball. In an exemplary embodiment shown in FIG. 14, second plurality of protrusions 220 and/or third plurality of protrusions 230 may be arranged near forefoot edge 310 on underside 300 of article 100 to assist in trapping a ball between article 100 and a ground surface.

In other embodiments, different types of protrusions may be arranged to provide different functions for ball control portion 120. In one embodiment, third plurality of protrusions 230 may be associated with a type of protrusion that provides traction with a ground surface. With this arrangement, third plurality of protrusions 230 on ball control portion 120 may be disposed on underside 300 of article 100 to provide enhanced traction for article 100.

In this embodiment, ball control portion 120 includes three different types of protrusions. In other embodiments, ball control portion 120 may include less or more different types of protrusions. Further, different types of protrusions may include one or more of the exemplary embodiments of protrusions as described above and/or below in reference to FIGS. 15 through 18, as well as any other type of protrusions not described herein.

Figure 15:
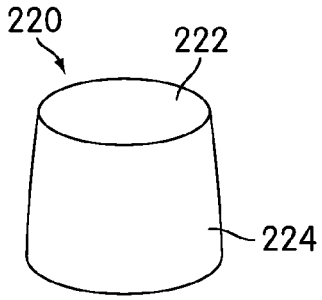
FIG. 15 is an enlarged view of an alternate embodiment of a protrusion associated with a ball control portion.

FIGS. 15 through 18 illustrate various alternate exemplary embodiments of different types of protrusions that may be used in any of the embodiments of a ball control surface discussed herein. Referring now to FIG. 15, protrusion 220 may be associated with a generally cylindrical shape. In this embodiment, cylindrical protrusion 220 may include a top face 222 and a barrel 224. Top face 222 may be oriented in a direction facing outwards from the surface of the ball control portion of an article. With this arrangement, top face 222 may contact a ball and/or a ground surface. In this embodiment, barrel 224 may provide rigidity to cylindrical protrusion 220. In contrast to first protrusion 600, as discussed in reference to FIGS. 6-8 above, barrel 224 of cylindrical protrusion 220 may be designed to prevent or limit bending of cylindrical protrusion 220. In some cases, cylindrical protrusion 220 may have a cross-sectional diameter that tapers slightly from the bottom upwards towards top face 222. In other cases, cylindrical protrusion 220 may have a cross-sectional diameter that is substantially the same from top to bottom along the vertical direction.

Figure 16:
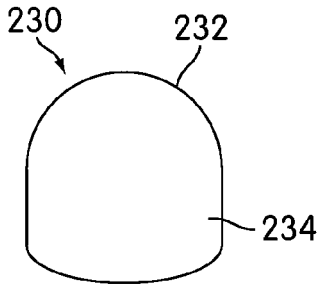
FIG. 16 is an enlarged view of an alternate embodiment of a protrusion associated with a ball control portion.

FIG. 16 illustrates an alternate exemplary embodiment of a protrusion 230. In this embodiment, protrusion 230 may be associated with a rounded spherical shape. As shown in FIG. 16, protrusion 230 may include a rounded top surface 232 and a base 234. Rounded top surface 232 may be oriented in a direction facing outwards from the surface of the ball control portion of an article. With this arrangement, rounded top surface 232 may contact a ball and/or a ground surface. In this embodiment, base 234 may be cylindrical. In other embodiments, base 234 may be a spherical or rounded shape. Base 234 may provide rigidity to rounded protrusion 230.

Figure 17:
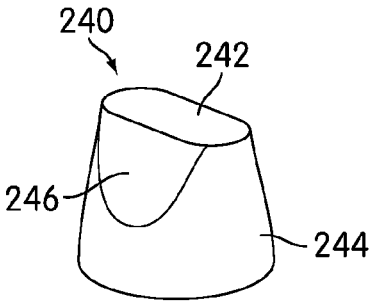
FIG. 17 is an enlarged view of an alternate embodiment of a protrusion associated with a ball control portion.

FIG. 17 illustrates an alternate exemplary embodiment of a protrusion 240. In this embodiment, protrusion 240 may be associated with a chiseled cylindrical shape. In one embodiment, chiseled cylindrical protrusion 240 may include a top face 242 and a base 244. Top face 242 may be oriented in a direction facing outwards from the surface of the ball control portion of an article. With this arrangement, top face 242 may contact a ball and/or a ground surface. In some embodiments, base 244 may be cylindrical and may provide rigidity to chiseled cylindrical protrusion 240.

In some embodiments, chiseled cylindrical protrusion 240 may include chisel face 246. In this embodiment, chisel face 246 may be arranged on one side of chiseled cylindrical protrusion 240 extending between top face 242 and base 244. With this arrangement, chisel face 246 may provide an additional contact surface for chiseled cylindrical protrusion 240 to make contact with a ball and/or ground surface. In some cases, chisel face 246 may be arranged on one side of chiseled cylindrical protrusion 240. In other cases, chisel face 246 may be provided on opposing sides of chiseled cylindrical protrusion 240.

Figure 18:
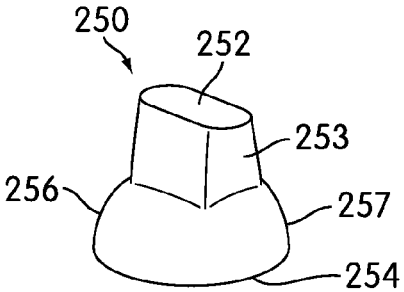
FIG. 18 is an enlarged view of an alternate embodiment of a protrusion associated with a ball control portion.

Referring now to FIG. 18, an alternate exemplary embodiment of a protrusion 250 is illustrated. In some embodiments, protrusion 250 may be a hybrid of one or more types of protrusions. In this embodiment, hybrid protrusion 250 may include a top portion 253 with a top face 252 associated with a fin-like shape, similar to first protrusion 600, described above. In other embodiments, top portion 253 may be associated with a chiseled shape, similar to chiseled cylindrical protrusion 240. In an exemplary embodiment, hybrid protrusion 250 may further include a bottom portion 254 associated with a generally rounded shape. In some embodiments, bottom portion 254 may be substantially similar to supporting member 610, discussed above. In other embodiments, bottom portion 254 may be similar to rounded protrusion 230.

In some embodiments, top portion 253 of hybrid protrusion 250 may be offset on bottom portion 254. In an exemplary embodiment, bottom portion 254 may be arranged to provide additional rigidity to hybrid protrusion 250 in one direction of bending. In an exemplary embodiment, a first rounded portion 256 on bottom portion 254 may be larger than a second rounded portion 257 on bottom portion 254. With this arrangement, first rounded portion 256 may provide additional rigidity to hybrid protrusion 250 in one direction of bending. In other embodiments, top portion 253 may be approximately centered on bottom portion 254 so that hybrid protrusion 250 may have substantially similar rigidity in opposing directions of bending.

Additionally, it will be understood that while the exemplary embodiments described in reference to FIGS. 15 through 18 illustrate cylindrical and/or rounded shaped protrusions, protrusions may be formed in any of various shapes, including but not limited to hexagonal, cylindrical, conical, circular, square, rectangular, trapezoidal, diamond, ovoid, as well as other regular or irregular and geometric or non-geometric shapes.

In some embodiments, ball control portion 120 may include protrusions of different dimensions and/or sizes. In an exemplary embodiment, protrusions of varying heights may be arranged along portions of ball control portion 120. In one embodiment, one or more protrusions having different heights may be associated with ball control portion 120 on any of medial side 16, lateral side 18, and/or underside 300 of article 100. In some cases, protrusions may vary in height along a lateral direction of ball control portion 120. In other cases, protrusions may vary in height along a longitudinal direction of ball control portion 120. In still other cases, protrusions may vary in height along both the lateral and longitudinal directions and/or at different portions of ball control portion 120.

Figure 19:
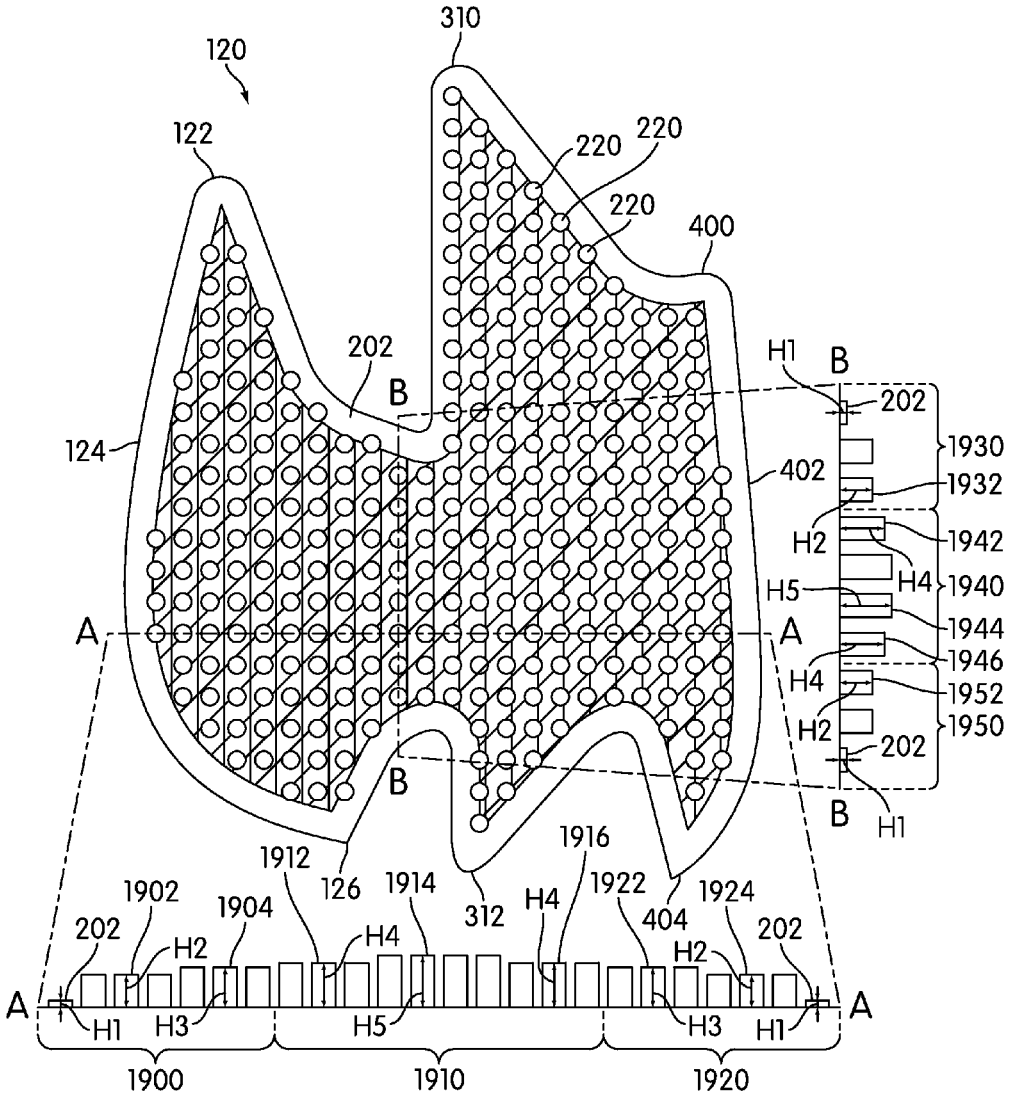
FIG. 19 is a schematic view of an alternate embodiment of a ball control portion with protrusions having varying heights.

FIG. 19 illustrates a schematic view of ball control portion 120 shown removed from article 100 and laid flat. In this embodiment, ball control portion 120 comprises lattice 202 and a plurality of protrusions. It should be understood that the plurality of protrusions shown in FIG. 19 are for exemplary purposes only and any protrusions described herein may have varying heights along portions of ball control portion 120.

In some embodiments, protrusions may have varying heights along portions of ball control portion 120 associated with different regions of article 100. FIG. 19 illustrates a lateral cross sectional view A of ball control portion 120. In this embodiment, ball control portion 120 may have a first lateral region 1900 that is associated with the portion of ball control portion 120 extending from medial front edge 122 to medial midsection edge 124 to medial rear edge 126 adjacent to upper 102 on medial side 16 of article 100. Ball control portion 120 also may have a second lateral region 1910 that is associated with ball control portion 120 on medial side 16 extending underneath article 100 to underside 300 between heel edge 312 and forefoot edge 314. Ball control portion 120 may have a third lateral region 1920 that is associated with the portion of ball control portion 120 extending from between heel edge 312 and forefoot edge 314 of underside 300 to lateral front edge 400 to lateral midsection edge 402 to lateral rear edge 404 adjacent to upper 102 on lateral side 18 of article 100.

In this embodiment, different regions of ball control portion 120 along a lateral direction may be associated with protrusions of varying heights. In an exemplary embodiment, first lateral region 1900 may be associated with protrusions having a first height range and second lateral region 1910 may be associated with protrusions having a second height range. In one embodiment, the first height range of protrusions associated with first lateral region 1900 may be smaller than the second height range of protrusions associated with second lateral region 1910. Similarly, third lateral region 1920 may be associated with protrusions having a third height range. In some cases, the third height range of protrusions associated with the third lateral region 1920 may be smaller than the second height range. In some embodiments, the third height range may be substantially similar to the first height range. In other cases, any of the first height range, the second height range, and/or the third height range may be larger or smaller than any one of the others.

In an exemplary embodiment, first lateral region 1900 may include protrusions associated with a first height range. In one embodiment, first lateral region 1900 may include lattice 202, a first group of protrusions, and/or a second group of protrusions. In this embodiment, lattice 202 of ball control portion 120 may have a first height H1. The first group of protrusions may be represented by a first protrusion 1902 having a second height H2. Similarly, the second group of protrusions may be represented by a second protrusion 1904 having a third height H3.

In some embodiments, third height H3 may be larger than second height H2. In this embodiment, first height H1 of lattice 202 is substantially smaller than second height H2 and/or third height H3 associated, respectively, with the first group and/or second group of protrusions. In one exemplary embodiment, first height H1, second height H2, and third height H3 may gradually increase from the medial edge of ball control portion 120 in a direction towards underside 300.

In different embodiments, the values of first height H1, second height H2 and third height H3 may vary. In some embodiments, first height H1 may have a value approximately in the range between 0 mm and 1 mm. Also, second height H2 may have a value approximately in the range between 1 mm and 2 mm. In addition, third height H3 may have a value approximately in the range between 1 mm and 3 mm. In an exemplary embodiment, first height H1, second height H2 and third height H3 may have approximate values of 0.5 mm, 1.2 mm and 2.2 mm, respectively. In other embodiments, however, first height H1, second height H2 and third height H3 may have any other values.

In an exemplary embodiment, second lateral region 1910 may include protrusions associated with a second height range. In one embodiment, second lateral region 1910 may include a third group of protrusions and/or a fourth group of protrusions. In this embodiment, the third group of protrusions may be represented by a third protrusion 1912 and a fifth protrusion 1916 both having a fourth height H4. Similarly, the fourth group of protrusions may be represented by a fourth protrusion 1914 having a fifth height H5.

In some embodiments, fifth height H5 may be larger than fourth height H4. In other embodiments, fourth height H4 and fifth height H5 may be substantially similar. In this embodiment, fifth height H5 and fourth height H4 are both larger than first height H1 associated with lattice 202, as well as second height H2 and/or third height H3 associated, respectively, with the first group and/or second group of protrusions in first lateral region 1900.

In different embodiments, the values of fourth height H4 and fifth height H5 may vary. In some embodiments, fourth height H4 may have a value approximately in the range between 2 mm and 3 mm. Also, fifth height H5 may have a value approximately in the range between 2 mm and 4 mm. In an exemplary embodiment, fourth height H4 and fifth height H5 may have approximate values of 2.5 mm and 3.5 mm, respectively. In other embodiments, however, fourth height H4 and fifth height H5 may have any other values.

In an exemplary embodiment, third lateral region 1920 may include protrusions associated with the first height range. In one embodiment, third lateral region 1920 may include lattice 202, a sixth group of protrusions, and/or a seventh group of protrusions. In this embodiment, lattice 202 of ball control portion 120 has first height H1. The sixth group of protrusions may be represented by a sixth protrusion 1922 having second height H2. Similarly, the seventh group of protrusions may be represented by a seventh protrusion 1924 having third height H3. In this embodiment, the sixth group of protrusions may have substantially similar heights as the first group of protrusions associated with first lateral region 1910. Similarly, the seventh group of protrusions may have substantially similar heights as the second group of protrusions associated with first lateral region 1910.

In one exemplary embodiment, the protrusions associated with ball control portion 120 increase in height from medial side 16 of ball control portion 120 at first lateral region 1900 towards underside 300 of article 100 to second lateral region 1910. Similarly, the protrusions associated with ball control portion 120 decrease in height from second lateral region 1910, towards third lateral region 1920 on lateral side 18 of article 100. In other embodiments, the height of protrusions in a lateral direction may remain substantially the same across ball control portion 120.

Referring again to FIG. 19, a longitudinal cross sectional view B of ball control portion 120 is illustrated. In this embodiment, ball control portion 120 may have a first longitudinal region 1930 that is associated with the portion of ball control portion 120 extending along a longitudinal direction from the forefoot side of the midfoot region of article 100 to the midsection of ball control portion 120. Ball control portion 120 also may have a second longitudinal region 1940 that is associated with the midsection of ball control portion 120. Ball control portion 120 may have a third longitudinal region 1950 that is associated with the portion of ball control portion 120 extending from the midsection along a longitudinal direction towards the heel side of the midfoot region of article 100.

In this embodiment, different regions of ball control portion 120 along a longitudinal direction may be associated with protrusions of varying heights, as discussed above in regard to varying heights along the lateral direction. In an exemplary embodiment, first longitudinal region 1930 may be associated with protrusions having a first height range and second longitudinal region 1940 may be associated with protrusions having a second height range. In one embodiment, the first height range of protrusions associated with first longitudinal region 1930 may be smaller than the second height range of protrusions associated with second longitudinal region 1940. Similarly, third longitudinal region 1950 may be associated with protrusions having a third height range. In some cases, the third height range of protrusions associated with the third longitudinal region 1950 may be smaller than the second height range. In some embodiments, the third height range may be substantially similar to the first height range. In other cases, any of the first height range, the second height range, and/or the third height range may be larger or smaller than any one of the others.

In an exemplary embodiment, first longitudinal region 1930 and/or third longitudinal region 1950 may include protrusions associated with the first height range. In one embodiment, first longitudinal region 1930 and/or third longitudinal region 1950 may include lattice 202 and a first group of protrusions. In this embodiment, lattice 202 of ball control portion 120 may have first height H1 and the first group of protrusions may be represented by a first protrusion 1932 and a fourth protrusion 1952, both having second height H2. In this embodiment, first height H1 of lattice 202 is substantially smaller than second height H2 associated with the first group of protrusions. In one exemplary embodiment, first height H1 and second height H2 may gradually increase from the front edge and/or rear edge of ball control portion 120 in a direction towards the midsection of ball control portion 120.

In an exemplary embodiment, second longitudinal region 1940 may include protrusions associated with the second height range. In one embodiment, second longitudinal region 1940 may include a second group of protrusions and/or a third group of protrusions. In this embodiment, the second group of protrusions may be represented by a third protrusion 1942 and a fifth protrusion 1946 both having a fourth height H4. Similarly, the third group of protrusions may be represented by a fourth protrusion 1944 having a fifth height H5.

In some embodiments, fifth height H5 may be larger than fourth height H4. In other embodiments, fourth height H4 and fifth height H5 may be substantially similar. In this embodiment, fifth height H5 and fourth height H4 are both larger than first height H1 associated with lattice 202 and second height H2 associated with the first group of protrusions in first longitudinal region 1930 and/or third longitudinal region 1950.

In different embodiments, the heights of protrusions associated with any of first longitudinal region 1930, second longitudinal region 1940, and/or third longitudinal region 1950 may vary. In one exemplary embodiment, lattice 202, the first group of protrusions, the second group of protrusions, and/or the third group of protrusions may have values of first height H1, second height H2, fourth height H4, and/or fifth height H5, as discussed above. In other embodiments, one or more protrusions associated with third height H3 may be included in any of first longitudinal region 1930, second longitudinal region 1940, and/or third longitudinal region 1950.

By varying the heights of protrusions across different portions of ball control portion 120, different amounts of control over a ball may be provided during contact with ball control portion 120. With this arrangement, protrusions at various portions of ball control portion 120 may be shorter or taller to provide greater or lesser amount of contact with a ball during a kick. Additionally, variation in heights of protrusions across portions of ball control portion 120 may be combined with variation in types of protrusions across portions of ball control portion 120, as discussed above in reference to FIGS. 14 through 18. By varying height, size, shape, rigidity, and/or other physical characteristics of protrusions on a ball control portion, different amounts and/or types of control may be provided when contacting a ball.

Article of footwear 100 may include additional provisions for enhancing traction of upper 102 for purposes of better ball control during kicks. In some cases, an upper may include portions comprising a material that has a high coefficient of friction to provide better grip on a ball during kicks. In other cases, an upper may include structural features on an upper to help enhance friction. For example, in some cases, an upper may include structural features that are intended to increase surface area at a point of contact of the ball which may help enhance traction between the upper and the ball.

Figure 20:
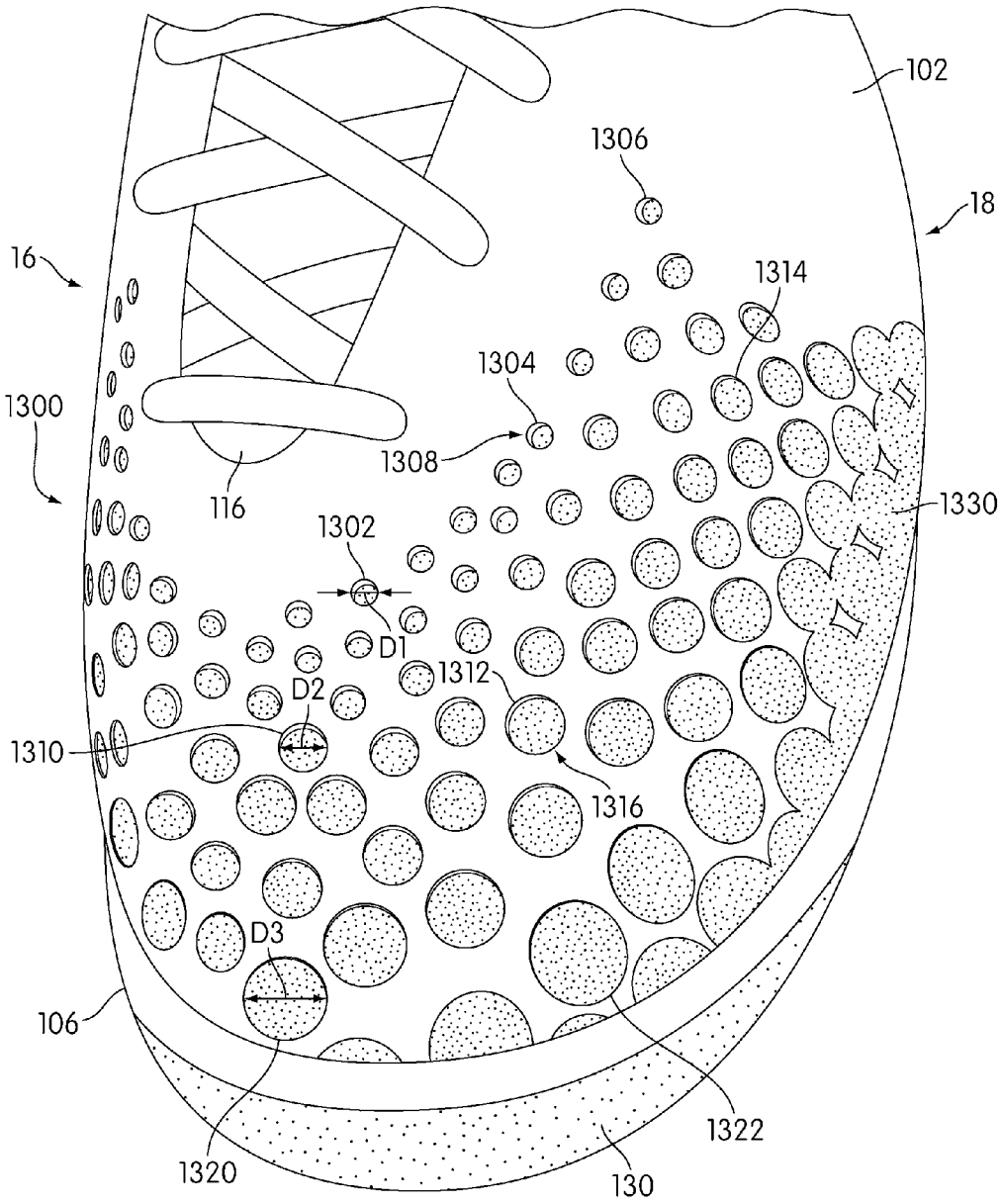
FIG. 20 is a top view of an embodiment of a forefoot region of an upper including a plurality of recesses.

Referring now to FIG. 20, upper 102 may include a plurality of recesses 1300 for enhancing traction of upper 102 with a ball. In some embodiments, plurality of recesses 1300 may be disposed in forefoot region 10 of upper 102. In other embodiments, plurality of recesses 1300 may be disposed on upper 102 in one or more of midfoot region 12 and/or heel region 14.

In some embodiments, plurality of recesses 1300 may include recesses of different sizes and/or depths. In one embodiment, plurality of recesses 1300 on upper 102 may include one or more recesses associated with a first size. In an exemplary embodiment, recesses associated with the first size may include a first recess 1302, a second recess 1304, and a third recess 1306. In this embodiment, each of first recess 1302, second recess 1304, and/or third recess 1306 may be associated with a first diameter D1. Similarly, plurality of recesses 1300 may include one or more recesses associated with a second size. In an exemplary embodiment, recesses associated with the second size may include a fourth recess 1310, a fifth recess 1312, and a sixth recess 1314. In this embodiment, each of fourth recess 1310, fifth recess 1312, and/or sixth recess 1314 may be associated with a second diameter D2. Likewise, plurality of recesses 1300 may include one or more recesses associated with a third size, including a seventh recess 1320 and an eighth recess 1322, which may be associated with a third diameter D3.

In an exemplary embodiment, first diameter D1 may be substantially smaller than second diameter D2 and/or third diameter D3. Similarly, second diameter D2 may be smaller than third diameter D3. In other embodiments, each of first diameter D1, second diameter D2, and/or third diameter D3 may be substantially similar to each other. In one embodiment, the diameter of plurality of recesses 1300 may vary along upper 102 from an area on upper 102 adjacent to lacing gap 116 towards sole structure 106. In an exemplary embodiment, the diameter of plurality of recesses 1300 increases in a direction from an area on upper 102 adjacent to lacing gap 116 towards outer periphery of upper 102 adjacent to sole structure 106. In other words, in FIG. 20, first recess 1302 associated with first diameter D1 is smaller than fourth recess 1310 associated with second diameter D2. Fourth recess 1310 is smaller than seventh recess 1320 associated with third diameter D3. In other embodiments, plurality of recesses 1300 may be arranged on upper 102 with other arrangements of varying diameters.

In one embodiment, plurality of recesses 1300 may be formed on upper 102 using embossing to dispose plurality of recesses 1300 below the surface of upper 102. Similarly, each of first recess 1302, second recess 1304, and/or third recess 1306 may be associated with a first depth 1308. First depth 1308 may be associated with a distance below the surface of upper 102. Likewise, each of fourth recess 1310, fifth recess 1312, and/or sixth recess 1314 may be associated with a second depth 1316. In one embodiment, second depth 1316 may be less than first depth 1308. In other embodiments, however, second depth 1316 may be substantially similar to, or larger than, first depth 1308. In this embodiment, seventh recess 1320 and eighth recess 1322 may not be associated with a depth. In this case, seventh recess 1320 and eighth recess 1322 may comprise an applied tactile material. In other embodiments, seventh recess 1320 and/or eighth recess 1322 may be associated with a depth below the surface of upper 102. It should be understood that article 100 may include any number of recesses disposed in upper 102.

In one embodiment, the depth of plurality of recesses 1300 may vary along upper 102 from an area on upper 102 adjacent to lacing gap 116 towards sole structure 106. In an exemplary embodiment, the depth of plurality of recesses 1300 decreases in a direction from an area on upper 102 adjacent to lacing gap 116 towards outer periphery of upper 102 adjacent to sole structure 106. In other embodiments, plurality of recesses 1300 may be arranged on upper 102 with other arrangements of varying depths.

In an exemplary embodiment, upper 102 may include a merged recess area 1330. In one embodiment, merged recess area 1330 may comprise one or more individual recesses of plurality of recesses 1300 that have been merged together to form a larger area. In this embodiment, merged recess area 1330 may be provided on lateral side 18 of forefoot region 10 of upper 102. In other embodiments, merged recess area 1330 may be provided on a portion of upper 102 where more control when kicking a ball is desired. In other embodiments, one or more of forefoot region 10, midfoot region 12, and/or heel region 14 may include a merged recess area substantially similar to merged recess area 1330.

In some embodiments, one or more of each of plurality of recesses 1300 may include an applied tactile material. In some cases, the applied tactile material may increase grip of upper 102 with a ball. In some embodiments, one or more of each of the plurality of recesses 1300 may be associated with a depth and/or an applied tactile material. In an exemplary embodiment, the applied tactile material may be disposed on a bottom of an embossed recess on upper 102. In one embodiment, the applied tactile material may be applied using screen printing. In an exemplary embodiment, the applied tactile material may include silicon or any other material that provides grip with a ball.

In an alternative embodiment, plurality of recesses 1300 may be formed by removing a portion of upper 102. In an exemplary alternative embodiment, plurality of recesses 1300 may be formed on upper 102 by cut-outs. In one embodiment, the material of upper 102 may be removed to expose a liner material underneath. In some cases, liner material below upper 102 may further include applied tactile material, as discussed above, to increase grip with a ball. In other cases, liner material below upper 102 may not include any additional applied tactile material. In other embodiments, selected recesses of plurality of recesses 1300 may be provided with applied tactile material in different portions of upper 102. In some cases, the selected recesses may be disposed in any one or more of forefoot region 10, midfoot region 12, and/or heel region, as well as on portions of medial side 16 and/or lateral side 18 of article 100.

While the various embodiments described above and shown in the Figures have illustrated article 100 including toe grip 130 disposed along an outer periphery of sole structure 106 at forefoot region 10, it should be understood that toe grip 130 is optional, and may not be included on article 100.

Figure 21:
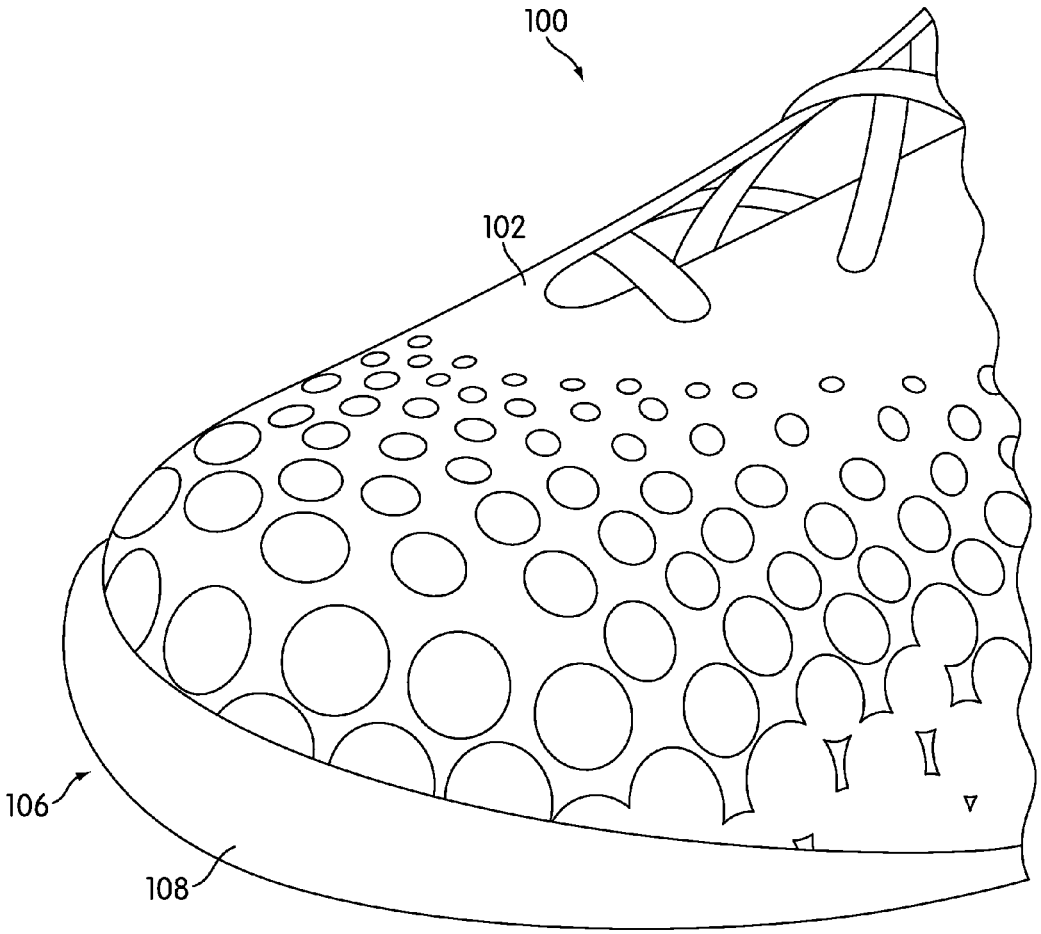
FIG. 21 is an enlarged view of an alternate embodiment of a forefoot region of an upper of an article of footwear.

In some embodiments, an outer periphery of sole structure 106 may include a traditional sole structure at forefoot region 10. Referring now to FIG. 21, in this embodiment, article 100 may include a smooth outer lip 108 disposed along the outer periphery of sole structure 106. In this embodiment, smooth outer lip 108 disposed along the outer periphery of sole structure 106 at forefoot region 10 may comprise a substantially similar material as sole structure 106. In various embodiments, smooth outer lip 108 may extend to different heights from sole structure 106 towards upper 102 at forefoot region 10. In this embodiment, smooth outer lip 108 may be a substantially smaller height than toe grip 130 as described in the previous embodiments. With this arrangement, smooth outer lip 108 may have a smaller surface area on article 100. In some embodiments, the smaller surface area of smooth outer lip 108 in forefoot region 10 of article 100 may allow plurality of recesses 1300, as described above, to have a greater surface area for contacting a ball.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. An article of footwear, comprising:

a ball control portion associated with at least a medial side of the article of footwear;

the ball control portion comprising a lattice including a plurality of protrusions that are configured to bend;

each protrusion of the plurality of protrusions including a base portion associated with the lattice and a top portion oriented in a direction facing outwards from the ball control portion;

wherein the lattice extends through a midfoot region of the medial side of the article of footwear from a rear edge to a front edge along a longitudinal direction;

wherein the plurality of protrusions are disposed across the lattice in rows approximately oriented along the longitudinal direction; and wherein the plurality of protrusions vary in height across the lattice between the rear edge and the front edge in the longitudinal direction.

2. The article of footwear according to claim 1, wherein the lattice includes a first longitudinal region associated with a first group of protrusions of the plurality of protrusions and a second longitudinal region associated with a second group of protrusions of the plurality of protrusions.

3. The article of footwear according to claim 2, wherein the first group of protrusions are associated with a first height range and the second group of protrusions are associated with a second height range; and wherein the first height range is smaller than the second height range.

4. The article of footwear according to claim 2, wherein the first longitudinal region is disposed adjacent to the rear edge of the lattice and the second longitudinal region is disposed forward of the first longitudinal region.

5. The article of footwear according to claim 2, wherein the lattice further includes a third longitudinal region associated with a third group of protrusions of the plurality of protrusions; and wherein the third longitudinal region is disposed forward of the second longitudinal region and is adjacent to the front edge of the lattice.

6. The article of footwear according to claim 5, wherein the first group of protrusions are associated with a first height range, the second group of protrusions are associated with a second height range, and the third group of protrusions are associated with a third height range; and wherein the second height range is larger than the first height range and the third height range.

7. The article of footwear according to claim 1, wherein ball control portion extends from the medial side to an underside of the article of footwear in a substantially continuous manner.

8. An article of footwear, comprising:

a ball control portion associated with at least a medial side of the article of footwear;

the ball control portion comprising a lattice including a plurality of protrusions that are configured to bend, each protrusion of the plurality of protrusions including a base portion associated with the lattice and a top portion oriented in a direction facing outwards from the ball control portion;

wherein the plurality of protrusions are arranged in a grid comprising a plurality of rows aligned along a longitudinal direction of the lattice and a plurality of columns aligned along a lateral direction of the lattice;

wherein the lattice extends through a midfoot region of the medial side of the article of footwear from a rear edge to a front edge such that the longitudinal direction of the lattice is oriented along a longitudinal direction of the article of footwear;

wherein the lattice further extends from a sole structure of the article of footwear to a midsection edge disposed along the medial side of the article of footwear such that the lateral direction of the lattice is oriented along a vertical direction of the article of footwear;

wherein the plurality of protrusions vary in height across the lattice between the rear edge and the front edge in the longitudinal direction of the lattice; and wherein the plurality of protrusions vary in height across the lattice from the sole structure to the midsection edge in the lateral direction of the lattice.

9. The article of footwear according to claim 8, wherein the lattice includes a first longitudinal region associated with a first group of protrusions of the plurality of protrusions disposed along the longitudinal direction of the lattice and a second longitudinal region associated with a second group of protrusions of the plurality of protrusions disposed along the longitudinal direction of the lattice.

10. The article of footwear according to claim 9, wherein the first group of protrusions are associated with a first height range and the second group of protrusions are associated with a second height range; and wherein the first height range is smaller than the second height range.

11. The article of footwear according to claim 8, wherein the lattice includes a first lateral region associated with a third group of protrusions of the plurality of protrusions disposed along the lateral direction of the lattice and a second lateral region associated with a fourth group of protrusions of the plurality of protrusions disposed along the lateral direction of the lattice.

12. The article of footwear according to claim 11, wherein the third group of protrusions are associated with a third height range and the fourth group of protrusions are associated with a fourth height range; and wherein the third height range is smaller than the fourth height range.

13. The article of footwear according to claim 8, wherein the plurality of protrusions generally increase in height in proximity to the sole structure along the lateral direction of the lattice.

14. The article of footwear according to claim 8, wherein the plurality of protrusions generally decrease in height towards the rear edge and the front edge from a midsection of the ball control portion along the longitudinal direction of the lattice.

15. The article of footwear according to claim 8, wherein the article of footwear comprises an upper and a sole structure; and wherein the ball control portion is substantially continuous between the medial side of the upper to an underside of the sole structure of the article of footwear.

16. An article of footwear, comprising:

an upper;

a sole structure;

a ball control portion associated with at least a medial side of the upper;

the ball control portion comprising a lattice including a plurality of protrusions that are configured to bend, each protrusion of the plurality of protrusions including a base portion associated with the lattice and a top portion oriented in a direction facing outwards from the ball control portion; and wherein the lattice extends from the sole structure to a midsection edge disposed along the medial side of the upper along a vertical direction of the article of footwear; and wherein the plurality of protrusions vary in height across the lattice from the sole structure to the midsection edge in the vertical direction of the article of footwear.

17. The article of footwear according to claim 16, wherein the lattice includes a first region associated with a first group of protrusions of the plurality of protrusions disposed along the vertical direction of the article of footwear adjacent to the midsection edge of the lattice; and wherein the lattice further includes a second region associated with a second group of protrusions of the plurality of protrusions disposed along the vertical direction of the article of footwear adjacent to the sole structure.

18. The article of footwear according to claim 17, wherein the first group of protrusions are associated with a first height range and the second group of protrusions are associated with a second height range; and wherein the first height range is smaller than the second height range.

19. The article of footwear according to claim 16, wherein the ball control portion further comprises a first portion extending in the vertical direction along the medial side of the article of footwear adjacent to the upper and a second portion extending in a lateral direction along an underside of the article of footwear adjacent to the sole structure.

20. The article of footwear according to claim 19, wherein the second portion is substantially continuous with the first portion; and wherein the plurality of protrusions vary in height across the lattice through the first portion and the second portion.

21. An article of footwear, comprising:

an upper;

a sole structure;

a ball control portion associated with the upper and the sole structure;

the ball control portion comprising a lattice including a plurality of protrusions that are configured to bend;

each protrusion of the plurality of protrusions including a base portion associated with the lattice and a top portion oriented in a direction facing outwards from the ball control portion; and wherein the ball control portion further comprises a first portion extending in a vertical direction along a medial side of the article of footwear adjacent to the upper and a second portion extending in a lateral direction along an underside of the article of footwear adjacent to the sole structure.

22. The article of footwear according to claim 21, wherein at least one protrusion of the plurality of protrusions has a generally cylindrical shape.

23. The article of footwear according to claim 22, wherein the base portion of the at least one protrusion having the generally cylindrical shape comprises a barrel and wherein the top portion comprises a top face.

24. The article of footwear according to claim 23, wherein the barrel tapers from the lattice towards the top face.

25. The article of footwear according to claim 21, wherein at least one protrusion of the plurality of protrusions has a rounded spherical shape.

26. The article of footwear according to claim 25, wherein the top portion of the at least one protrusion having the rounded spherical shape comprises a rounded top surface.

27. The article of footwear according to claim 21, wherein at least one protrusion of the plurality of protrusions has a chiseled cylindrical shape.

28. The article of footwear according to claim 27, wherein the top portion of the at least one protrusion having the chiseled cylindrical shape comprises a top face facing outwards from the ball control portion.

29. The article of footwear according to claim 28, wherein the at least one protrusion having the chiseled cylindrical shape further comprises a chisel face extending between the top face and the base portion.

30. The article of footwear according to claim 21, wherein the base portion of at least one protrusion of the plurality of protrusions has a rounded shape and wherein the top portion of the at least one protrusion has a fin-like shape.

31. The article of footwear according to claim 21, wherein the plurality of protrusions comprises at least two protrusions associated with different shapes.

32. The article of footwear according to claim 31, wherein at least one protrusion associated with the first portion of the ball control portion has a first shape; and wherein at least one protrusion associated with the second portion of the ball control portion has a second shape, the second shape being different from the first shape.

* * * * *